US011398241B1

(12) United States Patent
Mansour et al.

(10) Patent No.: US 11,398,241 B1
(45) Date of Patent: Jul. 26, 2022

(54) MICROPHONE NOISE SUPPRESSION WITH BEAMFORMING

(71) Applicant: Amazon Technologies, Inc., Seattle, WA (US)

(72) Inventors: Mohamed Mansour, Cupertino, CA (US); Shobha Devi Kuruba Buchannagari, Fremont, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 17/218,257

(22) Filed: Mar. 31, 2021

(51) Int. Cl.

| | |
|---|---|
| ***H04R 3/00*** | (2006.01) |
| ***G10L 21/02*** | (2013.01) |
| ***G10L 21/0216*** | (2013.01) |
| ***H04R 1/32*** | (2006.01) |
| ***H04R 3/02*** | (2006.01) |

(52) U.S. Cl.
CPC ..... *G10L 21/0216* (2013.01); *H04R 1/326* (2013.01); *H04R 3/02* (2013.01); *G10L 2021/02166* (2013.01)

(58) Field of Classification Search
CPC . H04R 1/32; H04R 1/326; H04R 3/00; H04R 3/02; H04R 3/04; H04R 3/005; G10L 21/02; G10L 21/0208; G10L 21/0216; G10L 2121/02161; G10L 2121/02165; G10L 2121/02166
See application file for complete search history.

(56) References Cited

U.S. PATENT DOCUMENTS

| | | | | |
|---|---|---|---|---|
| 9,521,486 | B1 * | 12/2016 | Barton | H04R 3/005 |
| 9,966,059 | B1 * | 5/2018 | Ayrapetian | H04R 1/08 |
| 9,973,849 | B1 * | 5/2018 | Zhang | H04R 3/005 |
| 10,237,647 | B1 * | 3/2019 | Chhetri | H04R 1/406 |
| 10,522,167 | B1 * | 12/2019 | Ayrapetian | G10L 17/18 |
| 10,553,236 | B1 * | 2/2020 | Ayrapetian | H04B 7/015 |
| 10,657,981 | B1 * | 5/2020 | Mansour | H04R 3/005 |
| 10,755,728 | B1 * | 8/2020 | Ayrapetian | G10L 21/0272 |
| 10,777,214 | B1 * | 9/2020 | Shi | H04R 29/001 |
| 2014/0067386 | A1 * | 3/2014 | Zhang | G10L 21/0208 704/226 |

(Continued)

FOREIGN PATENT DOCUMENTS

| | | | | |
|---|---|---|---|---|
| KR | 101312451 | B1 * | 9/2013 | G10L 21/02 |
| WO | WO-2009034524 | A1 * | 3/2009 | G10L 21/02 |

*Primary Examiner* — Thang V Tran
(74) *Attorney, Agent, or Firm* — Pierce Atwood LLP

(57) ABSTRACT

Techniques for improving microphone noise suppression are provided. A system for noise-suppression may include a beam selector component that applies logic to select a beam most likely corresponding to a direction of a noise source and keeps the beam selection steady rather than switching the beam too often to avoid processing complications. The selected beam may be used as a reference in an adaptive filter which outputs a noise estimate. The noise estimate and raw microphone data may be used to adapt the adaptive filter. A parallel filter which adapts after a time delay may be applied to the reference in order to prevent interference. An attenuation factor may be used to scale the noise estimate based on noise diffuseness, signal quality, and/or a gain limit. The scaled noise estimate may be subtracted from microphone input data to produce output audio data with improved signal quality and maintained signal coherence.

20 Claims, 13 Drawing Sheets

(56) References Cited

U.S. PATENT DOCUMENTS

| | | | | |
|---|---|---|---|---|
| 2015/0179160 | A1* | 6/2015 | Wu | H04R 3/005<br>381/71.8 |
| 2018/0249246 | A1* | 8/2018 | Kjems | H04R 3/005 |

* cited by examiner

MICROPHONE NOISE SUPPRESSION WITH BEAMFORMING

BACKGROUND

With the advancement of technology, the use and popularity of electronic devices has increased considerably. Electronic devices are commonly used to capture and process audio data.

BRIEF DESCRIPTION OF DRAWINGS

For a more complete understanding of the present disclosure, reference is now made to the following description taken in conjunction with the accompanying drawings.

DETAILED DESCRIPTION

Figure 1:
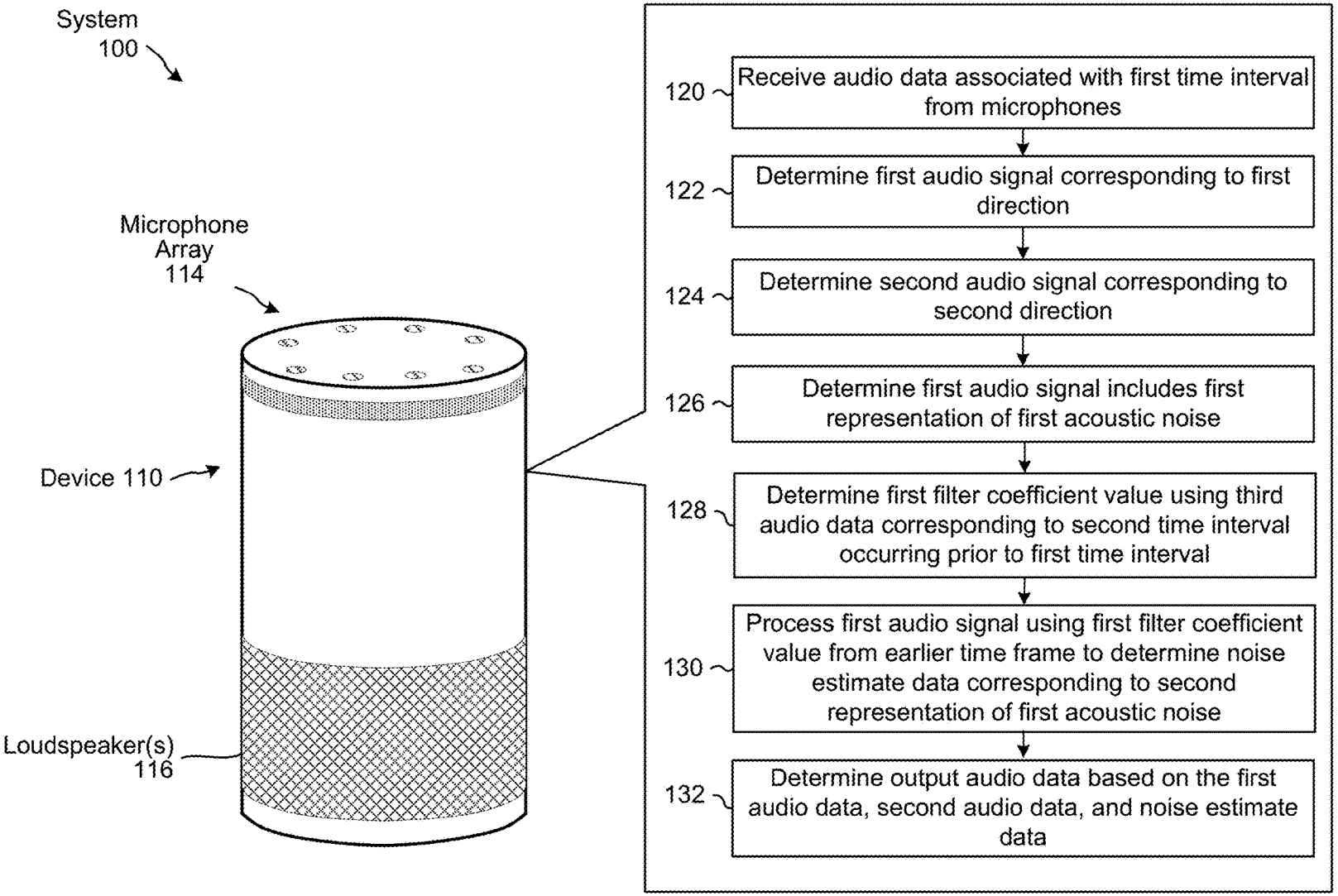
FIG. 1 illustrates a cascaded adaptive interference cancellation system according to embodiments of the present disclosure.

Electronic devices may be used to capture audio and process audio data. The audio data may be used for voice commands and/or sent to a remote device as part of a communication session. To process voice commands from a particular user or to send audio data that only corresponds to the particular user, the device may attempt to isolate desired speech associated with the user from undesired speech associated with other users and/or other sources of noise, such as audio generated by loudspeaker(s) or ambient noise in an environment around the device. An electronic device may perform noise cancellation to remove, from the audio data, any undesired noise that may distract from the desired audio the device (for example, user speech) that is attempting capture.

Audio signals may be captured with microphones (e.g., of a microphone array) of the device and various components of the device may process corresponding audio data to isolate the desired speech or target signal (e.g., a voice command) in view of less desired audio, such as audio from noise sources or other audio that is not the desired target signal. Such undesired audio may be generally referred to as noise/noise audio. Isolating the target signal may include improving a signal quality of the audio input at the microphones, however this may deteriorate signal coherency of the microphones. The signal quality may be measured by a signal quality metric such as a signal-to-interference ratio (SIR), a signal-to-noise ratio (SNR), or the like. The signal quality metric may indicate a power level of the target signal compared to a power level of background noise. Signal coherency may indicate how much the information in audio signals (e.g., the target signal) captured by the microphones has been distorted due to audio processing.

By preserving signal coherency, signal information relevant to the target signal may be distorted less, which may allow for improved downstream processing of the target signal. Thus, due to various system and signal constraints, a compromise or trade-off may exist between improving signal quality and preserving signal information in the audio signals captured by the microphones (e.g., signal coherence). This compromise may need to be optimized based on the relative importance of signal quality as compared to the relative importance of signal coherence. Systems and methods that facilitate controlling the trade-off between signal quality and signal coherence are provided in the present disclosure.

For example, a noise-suppression system with a configuration of various components as described in the present disclosure may facilitate control of the amount of noise removed from microphone input based on signal quality at the microphone input and directivity/diffuseness of the noise. Directivity may measure a directional characteristic of a sound source such as a noise source. Diffuseness may measure how widely spread out sound (e.g., noise) may be in an area such as room.

A system for noise-suppression may include a beam selector component that applies logic to select a beam most likely corresponding to a direction of a noise source. The logic/component may be designed to, in certain conditions, keep the beam selection steady rather than switching the beam too often to avoid processing complications. The selected beam may be used as a reference in an adaptive filter which outputs a noise estimate. The noise estimate and raw microphone data (e.g., microphone input data) may be used to adapt the adaptive filter. Instead of directly using the output of the adaptive filter, a parallel filter which adapts after a time delay may be applied to the reference in order to prevent interference due to possible double-talk. The time delay (which may correspond to a length of time it takes to utter a wakeword) may allow the noise suppressor to operate under the assumption that the audio coming from the direction with the highest energy before the device 110 detects the wakeword is noise, that audio received during the time delay is representative of the wakeword, and that audio received after the time delay (e.g., after the wakeword) is noise and desired audio (e.g., speech) that can be processed using data (such as filter coefficients) that were calculated before the wakeword was detected. In this way the system may remove the pre-wakeword noise from the post-wakeword noise plus speech. After passing the reference through the parallel filter, an attenuation factor may be used to scale the noise estimate based on diffuseness of the noise, signal quality, and/or a gain limit. The scaled noise estimate may be subtracted from the microphone input data to produce output audio data with improved signal quality and maintained signal coherence.

It should be noted that while beamforming is discussed in detail below for explanatory purposes as aspects of beamforming are pertinent to the present disclosure, the techniques and feature described in the present disclosure for noise suppression may be directed to applications which use input microphone signals directly without beamforming. These applications may include, for example, sound source localization, sound source separation, and dereverberation. This may be in contrast to other applications where the objective may be to improve barge-in performance after beamforming. For those applications, beam-cancelling beam configurations such as adaptive reference algorithm (ARA) processing may be used to improve signal quality of the beamformed signal.

FIG. 1 illustrates a system for performing noise suppression with beamforming according to embodiments of the present disclosure. As illustrated in FIG. 1, the device 110 may include a microphone array 114 and one or more loudspeaker(s) 116. However, the disclosure is not limited thereto and the device 110 may include additional components without departing from the disclosure.

The device 110 may operate using a microphone array 114 comprising multiple microphones, where beamforming techniques may be used to isolate desired audio including speech. In audio systems, beamforming refers to techniques that are used to isolate audio from a particular direction in a multi-directional audio capture system. Beamforming may be particularly useful when filtering out noise from non-desired directions. Beamforming may be used for various tasks, including isolating voice commands to be executed by a speech-processing system.

One technique for beamforming involves boosting audio received from a desired direction while dampening audio received from a non-desired direction. In one example of a beamformer system, a fixed beamformer unit employs a filter-and-sum structure to boost an audio signal that originates from the desired direction (sometimes referred to as the look-direction) while largely attenuating audio signals that original from other directions. A fixed beamformer unit may effectively eliminate certain diffuse noise (e.g., undesirable audio), which is detectable in similar energies from various directions, but on its own may be less effective in eliminating noise emanating from a single source in a particular non-desired direction. The beamformer unit may also incorporate an adaptive beamformer unit/noise canceller that can adaptively cancel noise from different directions depending on audio conditions.

In some examples, the device 110 may receive playback audio data and may generate output audio corresponding to the playback audio data using the one or more loudspeaker(s) 116. While generating the output audio, the device 110 may capture input audio data using the microphone array 114. In addition to capturing speech (e.g., input audio data that includes a representation of speech), the device 110 may capture a portion of the output audio generated by the loudspeaker(s) 116, which may be referred to as an "echo" or echo signal. Conventional systems may isolate the speech in the input audio data by performing acoustic echo cancellation (AEC) to remove the echo signal from the input audio data. For example, conventional acoustic echo cancellation may generate a reference signal based on the playback audio data and may remove the reference signal from the input audio data to generate output audio data representing the speech.

As an alternative to generating the reference signal based on the playback audio data, ARA processing may generate an adaptive reference signal based on the input audio data. To illustrate an example, the ARA processing may perform beamforming using the input audio data to generate a plurality of audio signals (e.g., beamformed audio data) corresponding to particular directions. For example, the plurality of audio signals may include a first audio signal corresponding to a first direction, a second audio signal corresponding to a second direction, a third audio signal corresponding to a third direction, and so on. The ARA processing may select the first audio signal as a target signal (e.g., the first audio signal includes a representation of speech) and the second audio signal as a reference signal (e.g., the second audio signal includes a representation of the echo and/or other acoustic noise) and may perform AEC by removing the reference signal from the target signal. As the input audio data is not limited to the echo signal, the ARA processing may remove other acoustic noise represented in the input audio data in addition to removing the echo. Therefore, the ARA processing may be referred to as performing AEC, adaptive noise cancellation (ANC), and/or adaptive interference cancellation (AIC) (e.g., adaptive acoustic interference cancellation) without departing from the disclosure.

As discussed in greater detail below, the device 110 may include an adaptive beamformer and may be configured to perform AEC/ANC/AIC using the ARA processing to isolate the speech in the input audio data. The adaptive beamformer may dynamically select target signal(s) and/or reference signal(s). Thus, the target signal(s) and/or the reference signal(s) may be continually changing over time based on speech, acoustic noise(s), ambient noise(s), and/or the like in an environment around the device 110. For example, the adaptive beamformer may select the target signal(s) by detecting speech, based on signal strength values or signal quality metrics (e.g., signal-to-noise ratio (SNR) values, average power values, etc.), and/or using other techniques or inputs, although the disclosure is not limited thereto. As an example of other techniques or inputs, the device 110 may capture video data corresponding to the input audio data, analyze the video data using computer vision processing (e.g., facial recognition, object recognition, or the like) to determine that a user is associated with a first direction, and select the target signal(s) by selecting the first audio signal corresponding to the first direction. Similarly, the adaptive beamformer may identify the reference signal(s) based on the signal strength values and/or using other inputs without departing from the disclosure. Thus, the target signal(s) and/or the reference signal(s) selected by the adaptive beamformer may vary, resulting in different filter coefficient values over time.

As discussed above, the device 110 may perform beamforming (e.g., perform a beamforming operation to generate beamformed audio data corresponding to individual directions). As used herein, beamforming (e.g., performing a beamforming operation) corresponds to generating a plurality of directional audio signals (e.g., beamformed audio data) corresponding to individual directions relative to the microphone array. For example, the beamforming operation may individually filter input audio signals generated by multiple microphones in the microphone array 114 (e.g., first audio data associated with a first microphone, second audio data associated with a second microphone, etc.) in order to separate audio data associated with different directions. Thus, first beamformed audio data corresponds to audio data associated with a first direction, second beamformed audio data corresponds to audio data associated with a second direction, and so on. In some examples, the device 110 may generate the beamformed audio data by boosting an audio signal originating from the desired direction (e.g., look direction) while attenuating audio signals that originate from other directions, although the disclosure is not limited thereto.

To perform the beamforming operation, the device 110 may apply directional calculations to the input audio signals. In some examples, the device 110 may perform the directional calculations by applying filters to the input audio signals using filter coefficients associated with specific directions. For example, the device 110 may perform a first directional calculation by applying first filter coefficients to the input audio signals to generate the first beamformed audio data and may perform a second directional calculation by applying second filter coefficients to the input audio signals to generate the second beamformed audio data.

The filter coefficients used to perform the beamforming operation may be calculated offline (e.g., preconfigured ahead of time) and stored in the device 110. For example, the device 110 may store filter coefficients associated with hundreds of different directional calculations (e.g., hundreds of specific directions) and may select the desired filter coefficients for a particular beamforming operation at runtime (e.g., during the beamforming operation). To illustrate an example, at a first time the device 110 may perform a first beamforming operation to divide input audio data into 36 different portions, with each portion associated with a specific direction (e.g., 10 degrees out of 360 degrees) relative to the device 110. At a second time, however, the device 110 may perform a second beamforming operation to divide input audio data into 6 different portions, with each portion associated with a specific direction (e.g., 60 degrees out of 360 degrees) relative to the device 110.

These directional calculations may sometimes be referred to as "beams" by one of skill in the art, with a first directional calculation (e.g., first filter coefficients) being referred to as a "first beam" corresponding to the first direction, the second directional calculation (e.g., second filter coefficients) being referred to as a "second beam" corresponding to the second direction, and so on. Thus, the device 110 stores hundreds of "beams" (e.g., directional calculations and associated filter coefficients) and uses the "beams" to perform a beamforming operation and generate a plurality of beamformed audio signals. However, "beams" may also refer to the output of the beamforming operation (e.g., plurality of beamformed audio signals). Thus, a first beam may correspond to first beamformed audio data associated with the first direction (e.g., portions of the input audio signals corresponding to the first direction), a second beam may correspond to second beamformed audio data associated with the second direction (e.g., portions of the input audio signals corresponding to the second direction), and so on. For ease of explanation, as used herein "beams" refer to the beamformed audio signals that are generated by the beamforming operation. Therefore, a first beam corresponds to first audio data associated with a first direction, whereas a first directional calculation corresponds to the first filter coefficients used to generate the first beam.

Figure 2:
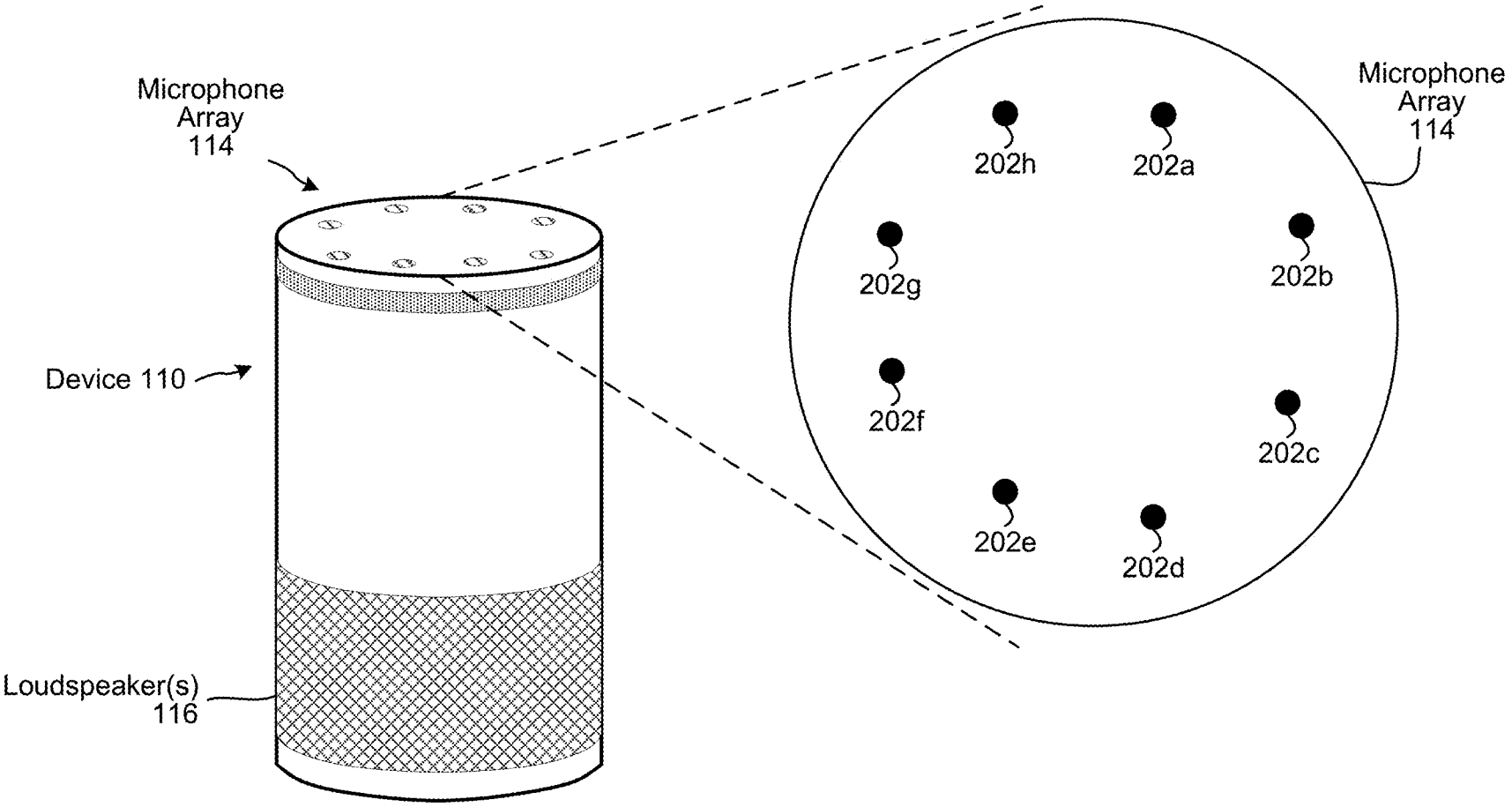
FIG. 2 illustrates a microphone array according to embodiments of the present disclosure.

As illustrated in FIG. 1, the device 110 may receive (120) microphone audio data (e.g., audio data 810) corresponding to audio captured by the microphone array 114. The audio data may include first audio data associated with a first microphone (e.g., microphone 202*g* as shown in FIG. 2) and second audio data associated with a second microphone (e.g., microphone 202*e* as shown in FIG. 2). The first and second audio data may be associated with audio from a first time interval.

Figure 3A:
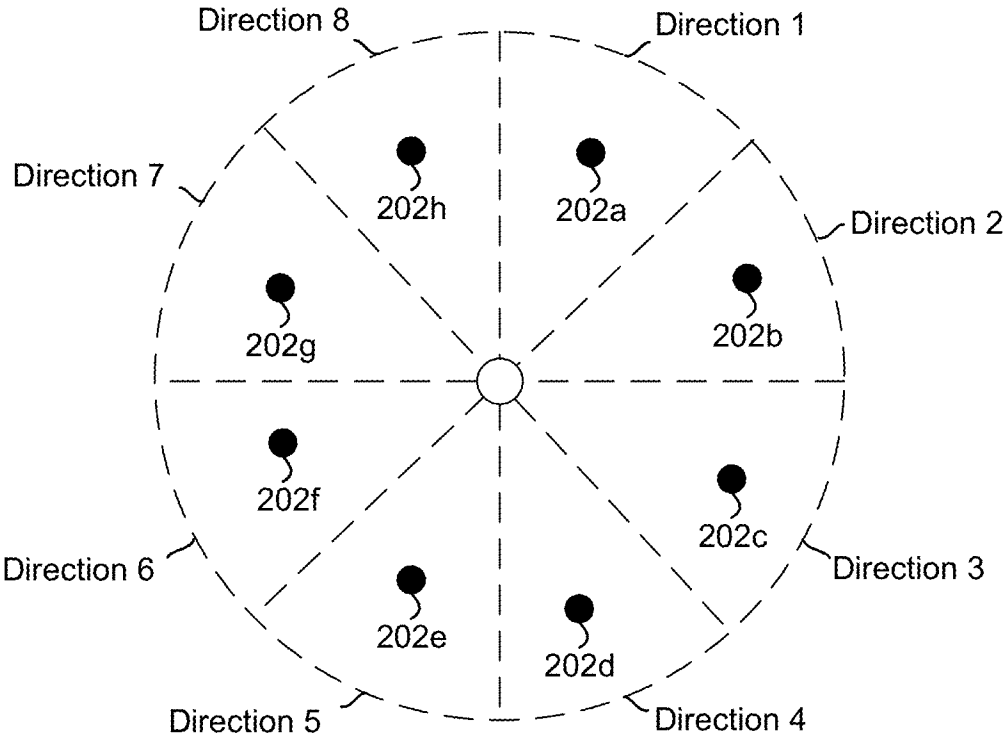
FIG. 3A illustrates associating directions with microphones of a microphone array according to embodiments of the present disclosure.
Figure 3B:
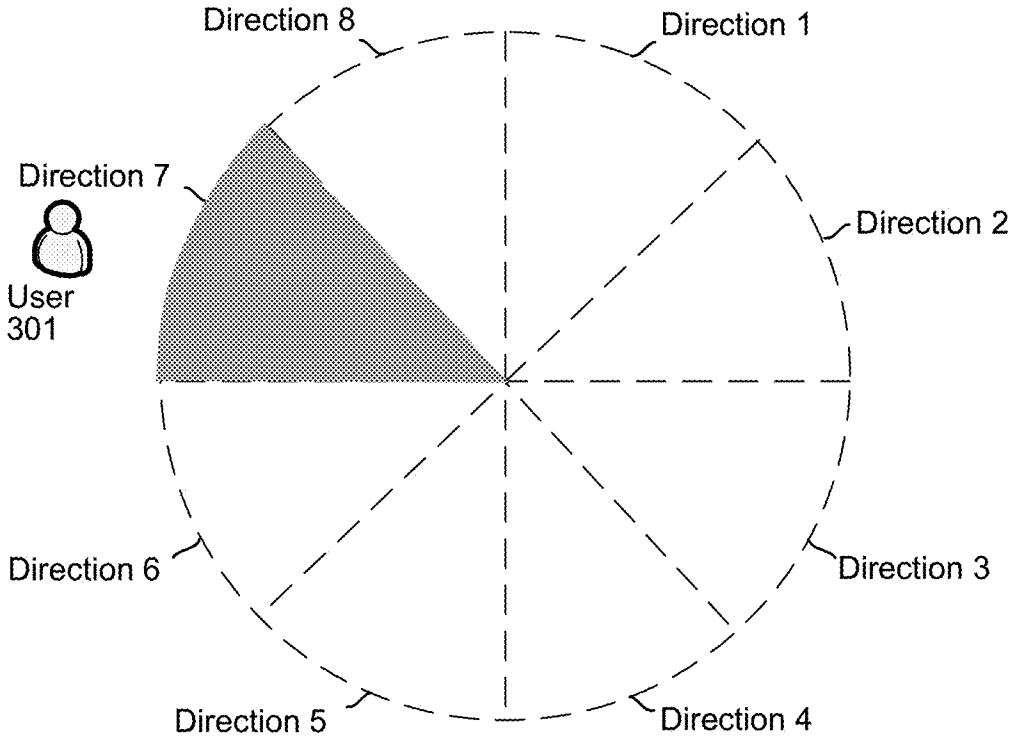
FIGS. 3B and 3C illustrate isolating audio from a direction to focus on a desired audio source according to embodiments of the present disclosure.
Figure 3C:
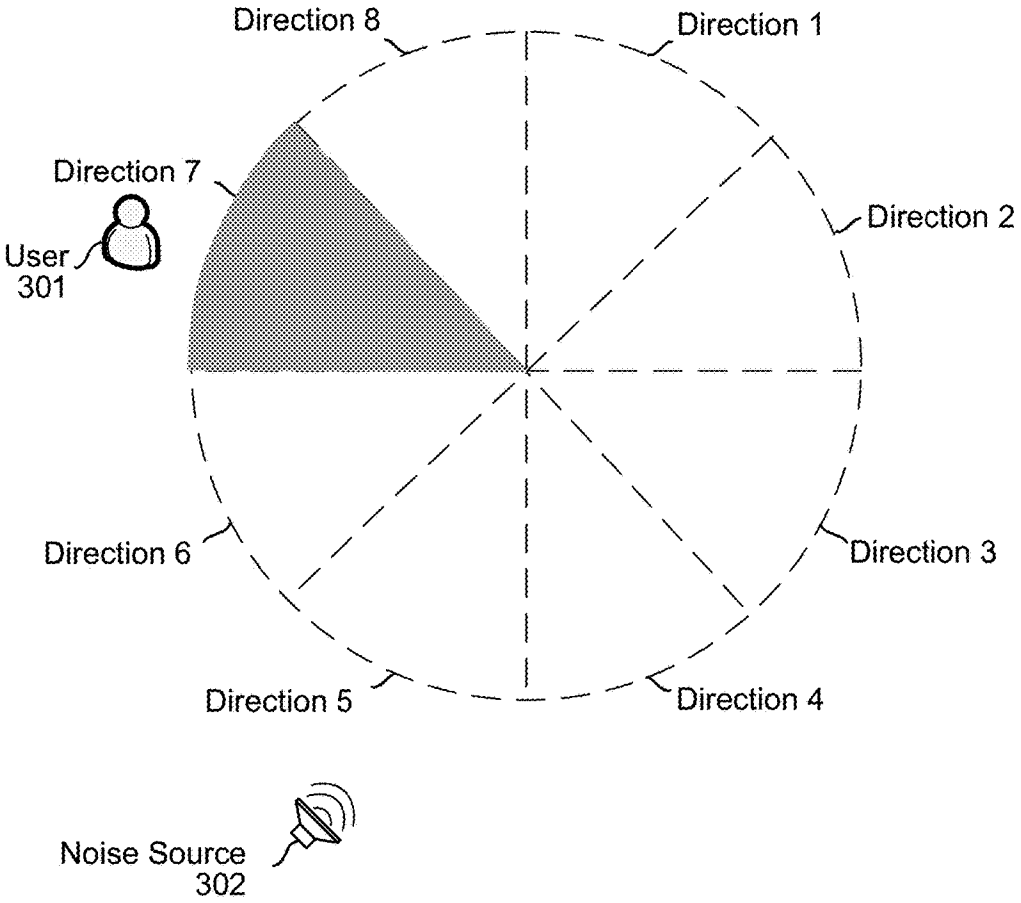
Figure 4:
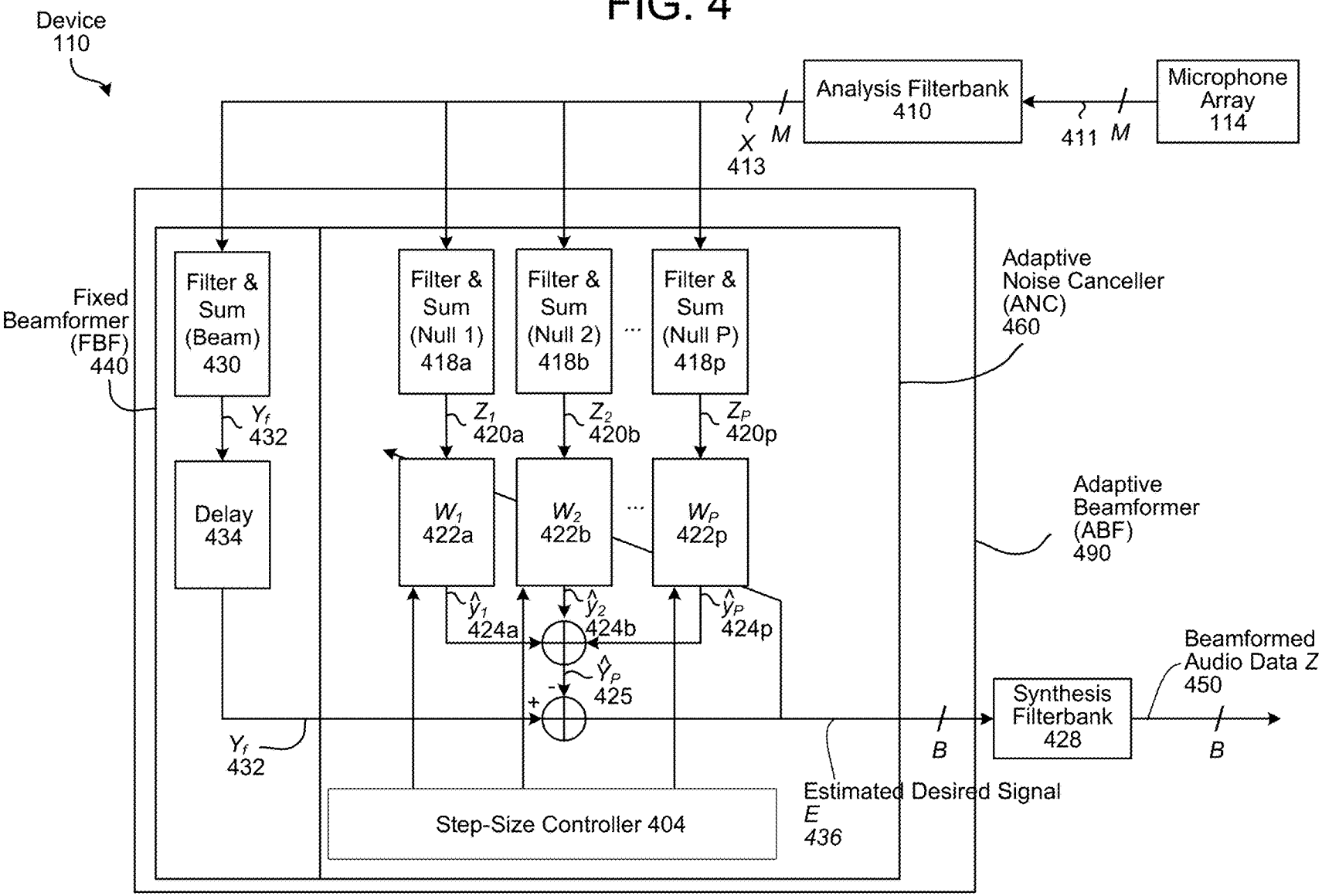
FIG. 4 illustrates a beamforming device that combines a fixed beamformer unit and an adaptive beamformer unit according to embodiments of the present disclosure.

The device 110 may also determine (122) a first audio signal (e.g., one of beamformed audio signals 822) corresponding to a first direction (e.g., direction 7 as shown in FIG. 3C) and determine (124) a second audio signal (e.g., one of beamformed audio signals 822) corresponding to a second direction (e.g., direction 5 as shown in FIG. 3C). One or more beamformers (e.g., FBF 440 and/or ABF 490 as shown in FIG. 4) may be used to determine the first and second audio signals. Further, the device 110 may determine (126) that the first audio signal includes a first representation of first acoustic noise (e.g., from a noise source 302 as shown in FIG. 3C).

Additionally, the device 110 may determine (128) a first filter coefficient value (e.g., via adaptive filter 860) using third audio data (e.g., microphone audio data) corresponding to a second time interval occurring prior to the first time interval. The device 110 may process (130) the first audio signal using a first filter coefficient value (e.g., via parallel filter 870, which receives coefficients for time t−Δ from adaptive filter 860) to determine noise estimate data (e.g., noise estimate data 872) corresponding to a second representation of the first acoustic noise (e.g., from the noise source 302 as shown in FIG. 3C). The noise estimate data may correspond to a number microphones in the microphone array 114. Further, there may be a filter coefficient value corresponding to each microphone. The filter coefficient value corresponding to each microphone may be different. The first filter coefficient value may correspond to a second, earlier, time interval such that the first time interval occurs after the second time interval. Moreover, the device 110 may determine (132) output audio data (e.g., output 880) based on the first audio data, the second audio data, and the noise estimate data. Further details of the device operation are described below following a discussion of directionality in reference to FIGS. 2-3C.

As illustrated in FIG. 2, a device 110 may include, among other components, a microphone array 114, one or more loudspeaker(s) 116, a beamformer unit (as discussed below), or other components. The microphone array may include a number of different individual microphones. In the example configuration of FIG. 2, the microphone array 114 includes eight (8) microphones, 202*a*-202*h*. The individual microphones may capture sound and pass the resulting audio signal created by the sound to a downstream component, such as an analysis filterbank discussed below. Each individual piece of audio data captured by a microphone may be in a time domain. To isolate audio from a particular direction, the device may compare the audio data (or audio signals related to the audio data, such as audio signals in a sub-band domain) to determine a time difference of detection of a particular segment of audio data. If the audio data for a first microphone includes the segment of audio data earlier in time than the audio data for a second microphone, then the device may determine that the source of the audio that resulted in the segment of audio data may be located closer to the first microphone than to the second microphone (which resulted in the audio being detected by the first microphone before being detected by the second microphone).

Using such direction isolation techniques, a device 110 may isolate directionality of audio sources. As shown in FIG. 3A, a particular direction may be associated with a particular microphone of a microphone array, where the azimuth angles for the plane of the microphone array may be divided into bins (e.g., 0-45 degrees, 46-90 degrees, and so forth) where each bin direction is associated with a microphone in the microphone array. For example, direction 1 is associated with microphone 202*a*, direction 2 is associated with microphone 202*b*, and so on. Alternatively, particular directions and/or beams may not necessarily be associated with a specific microphone.

To isolate audio from a particular direction the device may apply a variety of audio filters to the output of the microphones where certain audio is boosted while other audio is dampened, to create isolated audio corresponding to a particular direction, which may be referred to as a beam. While the number of beams may correspond to the number of microphones, this need not be the case. For example, a two-microphone array may be processed to obtain more than two beams, thus using filters and beamforming techniques to isolate audio from more than two directions. Thus, the number of microphones may be more than, less than, or the same as the number of beams. The beamformer unit of the device may have an ABF unit/FBF unit processing pipeline for each beam, as explained below.

The device may use various techniques to determine the beam corresponding to the look-direction. If audio is detected first by a particular microphone the device 110 may determine that the source of the audio is associated with the direction of the microphone in the array. Other techniques may include determining what microphone detected the audio with a largest amplitude (which in turn may result in a highest strength of the audio signal portion corresponding to the audio). Other techniques (either in the time domain or in the sub-band domain) may also be used such as calculating a SNR for each beam, performing voice activity detection (VAD) on each beam, or the like.

For example, if audio data corresponding to a user's speech is first detected and/or is most strongly detected by microphone 202*g*, the device may determine that the user is located in a location in direction 7. Using a FBF unit or other such component, the device may isolate audio coming from direction 7 using techniques known to the art and/or explained herein. Thus, as shown in FIG. 3B, the device 110 may boost audio coming from direction 7, thus increasing the amplitude of audio data corresponding to speech from user 301 relative to other audio captured from other directions. In this manner, noise from diffuse sources that is coming from all the other directions will be dampened relative to the desired audio (e.g., speech from user 301) coming from direction 7.

One drawback to the FBF unit approach is that it may not function as well in dampening/canceling noise from a noise source that is not diffuse, but rather coherent and focused from a particular direction. For example, as shown in FIG. 3C, a noise source 302 may be coming from direction 5 but may be sufficiently loud that noise canceling/beamforming techniques using an FBF unit alone may not be sufficient to remove all the undesired audio coming from the noise source 302, thus resulting in an ultimate output audio signal determined by the device 110 that includes some representation of the desired audio resulting from user 301 but also some representation of the undesired audio resulting from noise source 302.

FIG. 4 illustrates a high-level conceptual block diagram of a device 110 configured to performing beamforming using a fixed beamformer unit and an adaptive noise canceller that can remove noise from particular directions using adaptively controlled coefficients which can adjust how much noise is cancelled from particular directions. The FBF unit 440 may be a separate component or may be included in another component such as an adaptive beamformer (ABF) unit 490. As explained below, the FBF unit may operate a filter and sum component 430 to isolate the first audio signal from the direction of an audio source.

The device 110 may also operate an adaptive noise canceller (ANC) unit 460 to amplify audio signals from directions other than the direction of an audio source. Those audio signals represent noise signals so the resulting amplified audio signals from the ABF unit may be referred to as noise reference signals 420, discussed further below. The device 110 may then weight the noise reference signals, for example using filters 422 discussed below. The device may combine the weighted noise reference signals 424 into a combined (weighted) noise reference signal 425. Alternatively the device may not weight the noise reference signals and may simply combine them into the combined noise reference signal 425 without weighting. The device may then subtract the combined noise reference signal 425 from the amplified first audio signal 432 to obtain a difference 436. The device may then output that difference, which represents the desired output audio signal with the noise removed. The diffuse noise is removed by the FBF unit when determining the signal 432 and the directional noise is removed when the combined noise reference signal 425 is subtracted. The device may also use the difference to create updated weights (for example for filters 422) that may be used to weight future audio signals. The step-size controller 404 may be used modulate the rate of adaptation from one weight to an updated weight.

In this manner noise reference signals are used to adaptively estimate the noise contained in the output signal of the FBF unit using the noise-estimation filters 422. This noise estimate is then subtracted from the FBF unit output signal to obtain the final ABF unit output signal. The ABF unit output signal is also used to adaptively update the coefficients of the noise-estimation filters. Lastly, we make use of a robust step-size controller to control the rate of adaptation of the noise estimation filters.

As shown in FIG. 4, input audio data 411 captured by a microphone array may be input into an analysis filterbank 410. The filterbank 410 may include a uniform discrete Fourier transform (DFT) filterbank which converts input audio data 411 in the time domain into n microphone outputs 413 in the frequency/sub-band domain. The audio signal X may incorporate audio signals corresponding to multiple different microphones as well as different sub-bands (i.e., frequency ranges) as well as different frame or interval indices (i.e., time ranges). Thus the audio signal from the mth microphone may be represented as $X_m(k,n)$, where k denotes the sub-band index and n denotes the frame or interval index. The combination of all audio signals for all microphones for a particular sub-band index frame index may be represented as X(k,n).

Figure 5:
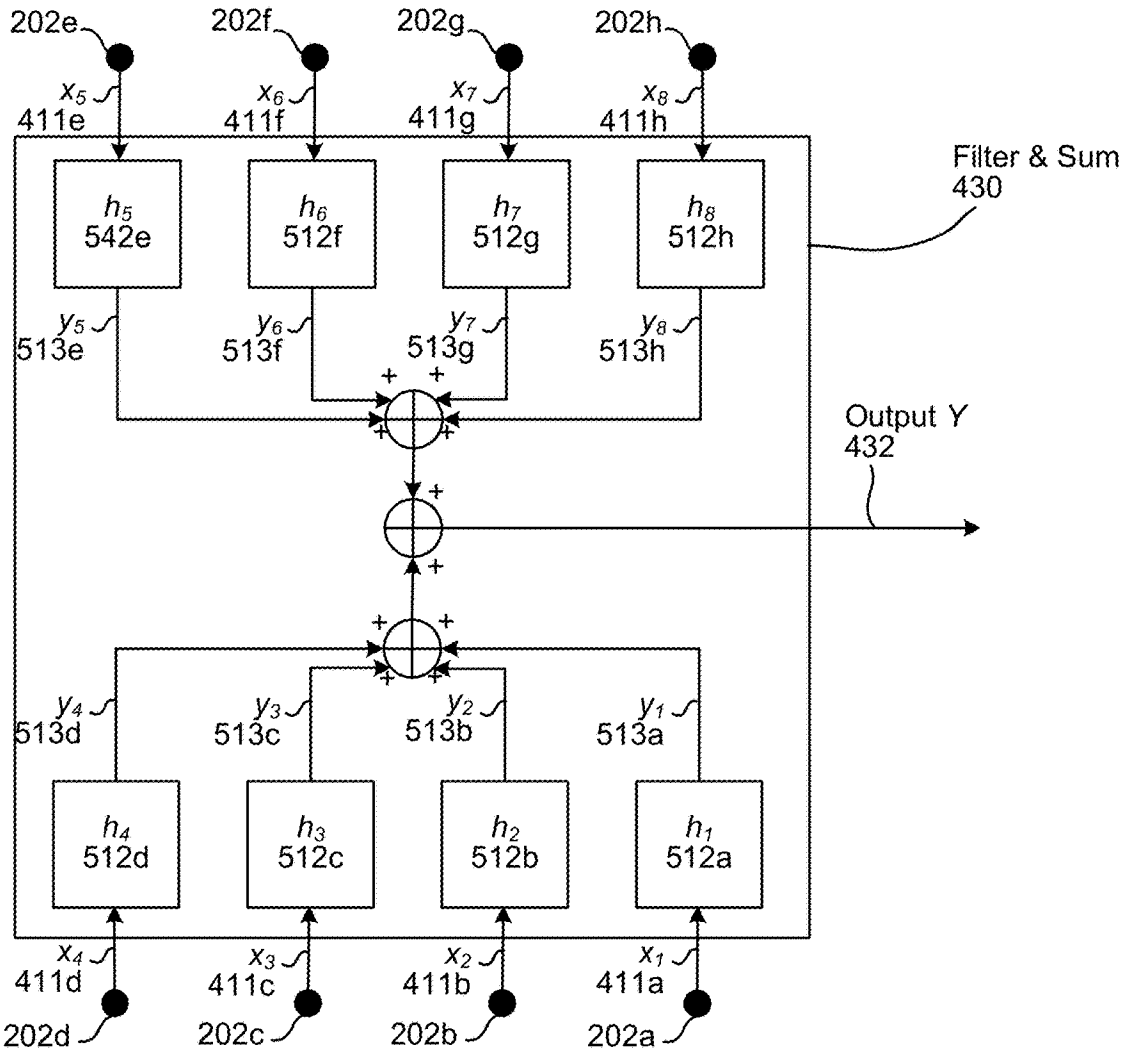
FIG. 5 illustrates a filter and sum component according to embodiments of the present disclosure.

The microphone outputs 413 may be passed to the FBF unit 440 including the filter and sum unit 430. The FBF unit 440 may be implemented as a robust super-directive beamformer unit, delayed sum beamformer unit, or the like. The FBF unit 440 is presently illustrated as a super-directive beamformer (SDBF) unit due to its improved directivity properties. The filter and sum unit 430 takes the audio signals from each of the microphones and boosts the audio signal from the microphone associated with the desired look direction and attenuates signals arriving from other microphones/directions. The filter and sum unit 430 may operate as illustrated in FIG. 5. As shown in FIG. 5, the filter and sum unit 430 may be configured to match the number of microphones of the microphone array. For example, for a microphone array with eight microphones, the filter and sum unit may have eight filter blocks 512. The input audio signals $x_1$ 411*a* through $x_8$ 411*h* for each microphone (e.g., microphones 1 through 8) are received by the filter and sum unit 430. The audio signals $x_1$ 411*a* through $x_8$ 411*h* correspond to individual microphones 202*a* through 202*h*, for example audio signal $x_1$ 411*a* corresponds to microphone 202*a*, audio signal $x_2$ 411*b* corresponds to microphone 202*b* and so forth. Although shown as originating at the microphones, the audio signals $x_1$ 411*a* through $x_8$ 411*h* may be in the sub-band domain and thus may actually be output by the analysis filterbank before arriving at the filter and sum component 430. Each filter block 512 is also associated with a particular microphone. Each filter block is configured to either boost (e.g., increase) or dampen (e.g., decrease) its respective incoming audio signal by the respective beamformer filter coefficient h depending on the configuration of the FBF unit. Each resulting filtered audio signal y 513 will be the audio signal x 411 weighted by the beamformer filter coefficient h of the filter block 512. For example, $y_1=x_1*h_1$, $y_2=x_2*h_2$, and so forth. The filter coefficients are configured for a particular FBF unit associated with a particular beam.

Figure 6:
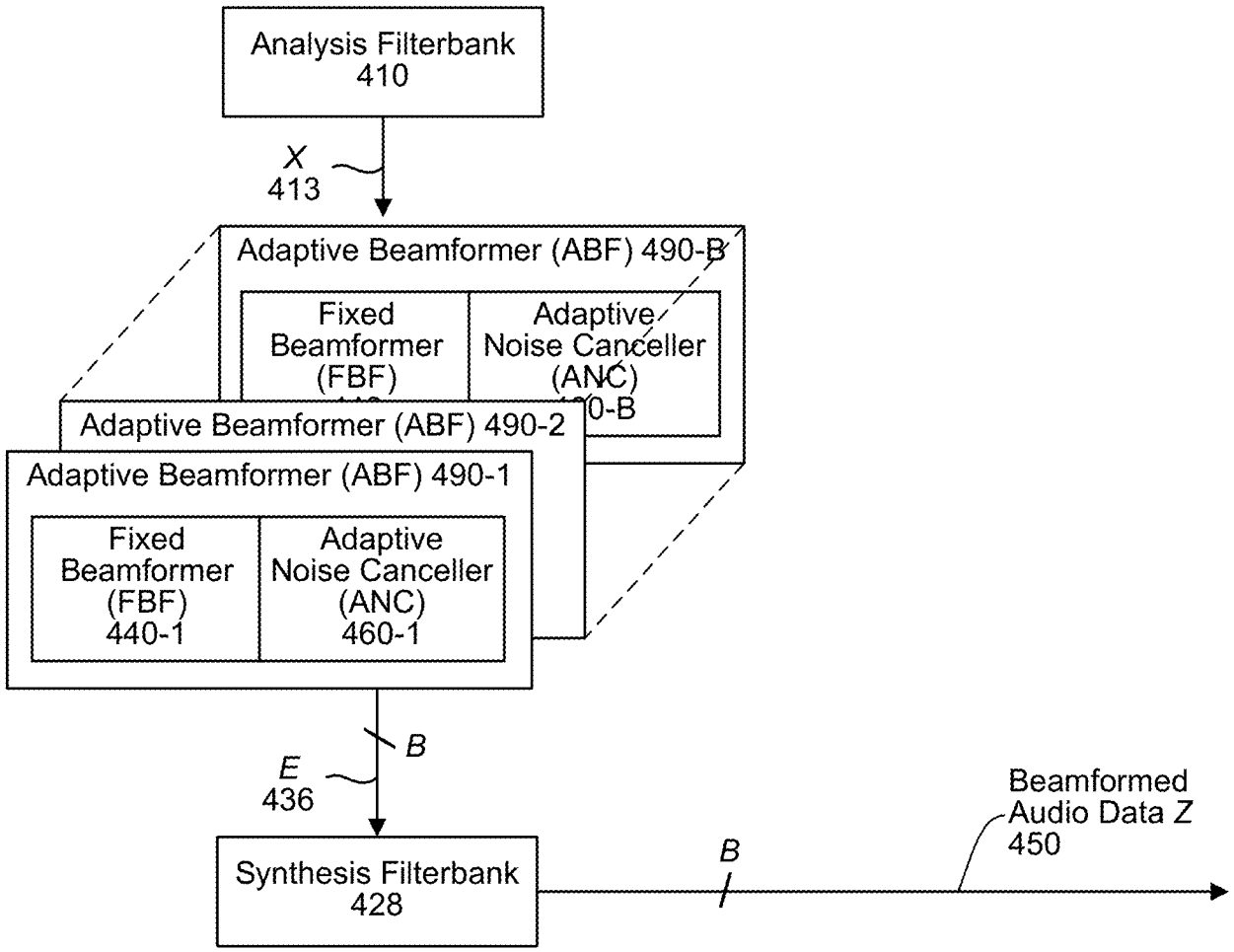
FIG. 6 illustrates a multiple fixed beamformer (FBF)/adaptive beamformer (ABF) beamformer unit configuration for each beam according to embodiments of the present disclosure.

As illustrated in FIG. 6, the adaptive beamformer (ABF) unit 490 configuration (including the FBF unit 440 and the ANC unit 460) illustrated in FIG. 4, may be implemented multiple times in a single device 110. The number of adaptive beamformer (ABF) unit 490 blocks may correspond to the number of beams B. For example, if there are eight beams, there may be eight FBF units 440 and eight ANC units 460. Each adaptive beamformer (ABF) unit 490 may operate as described in reference to FIG. 4, with an individual output E 436 for each beam created by the respective adaptive beamformer (ABF) unit 490. Thus, B different outputs 436 may result. For device configuration purposes, there may also be B different other components, such as the synthesis filterbank 428, but that may depend on device configuration. Each individual adaptive beamformer (ABF) unit 490 may result in its own beamformed audio data Z 450, such that there may be B different beamformed audio data portions Z 450. Each beam's respective beamformed audio data Z 450 may be in a format corresponding to an input audio data 411 or in an alternate format. For example, the input audio data 411 and/or the beamformed audio data Z 450 may be sampled at a rate corresponding to 16 kHz and a mono-channel at 16 bits per sample, little endian format. Audio data in little endian format corresponds to storing the least significant byte of the audio data in the smallest address, as opposed to big endian format where the most significant byte of the audio data is stored in the smallest address.

Each particular FBF unit may be tuned with filter coefficients to boost audio from one of the particular beams. For example, FBF unit 440-1 may be tuned to boost audio from beam 1, FBF unit 440-2 may be tuned to boost audio from beam 2 and so forth. If the filter block is associated with the particular beam, its beamformer filter coefficient h will be high whereas if the filter block is associated with a different beam, its beamformer filter coefficient h will be lower. For example, for FBF unit 440-7, direction 7, the beamformer filter coefficient $h_7$ for filter 512*g* may be high while beamformer filter coefficients $h_1$-$h_6$ and $h_8$ may be lower. Thus the filtered audio signal $y_7$ will be comparatively stronger than the filtered audio signals $y_1$-$y_6$ and $y_8$ thus boosting audio from direction 7 relative to the other directions. The filtered audio signals will then be summed together to create the output audio signal. For example, the filtered audio signals will then be summed together to create the output audio signal $Y_f$ 432. Thus, the FBF unit 440 may phase align microphone audio data toward a given direction and add it up, such that signals that are arriving from a particular direction are reinforced, but signals that are not arriving from the look direction are suppressed. The robust FBF coefficients are designed by solving a constrained convex optimization problem and by specifically taking into account the gain and phase mismatch on the microphones.

The individual beamformer filter coefficients may be represented as $H_{BF,m}(r)$, where r=0, . . . R, where R denotes the number of beamformer filter coefficients in the subband domain. Thus, the output $Y_f$ 432 of the filter and sum unit 430 may be represented as the summation of each microphone signal filtered by its beamformer coefficient and summed up across the M microphones:

$$Y(k,n)=\sum_{m=1}^{M}\sum_{r=0}^{R}H_{BF,m}(r)X_m(k,n-r) \tag{1}$$

Turning once again to FIG. 4, the output $Y_f$ 432, expressed in Equation 1, may be fed into a delay component 434, which delays the forwarding of the output Y until further adaptive noise canceling functions as described below may be performed. One drawback to output $Y_f$ 432, however, is that it may include residual directional noise that was not canceled by the FBF unit 440. To remove that directional noise, the device 110 may operate an adaptive noise canceller (ANC) unit 460 which includes components to obtain the remaining noise reference signal which may be used to remove the remaining noise from output Y.

As shown in FIG. 4, the adaptive noise canceller may include a number of nullformer blocks 418*a* through 418*p*. The device 110 may include P number of nullformer blocks 418 where P corresponds to the number of channels, where each channel corresponds to a direction in which the device may focus the nullformers 418 to isolate detected noise. The number of channels P is configurable and may be predetermined for a particular device 110. Each nullformer block is configured to operate similarly to the filter and sum block 430, only instead of the filter coefficients for the nullformer blocks being selected to boost the look ahead direction, they are selected to boost one of the other, non-look ahead directions. Thus, for example, nullformer 418*a* is configured to boost audio from direction 1, nullformer 418*b* is configured to boost audio from direction 2, and so forth. Thus, the nullformer may actually dampen the desired audio (e.g., speech) while boosting and isolating undesired audio (e.g., noise). For example, nullformer 418*a* may be configured (e.g., using a high filter coefficient $h_1$ 512*a*) to boost the signal from microphone 502*a*/direction 1, regardless of the look ahead direction. Nullformers 418*b* through 418*p* may operate in similar fashion relative to their respective microphones/directions, though the individual coefficients for a particular channel's nullformer in one beam pipeline may differ from the individual coefficients from a nullformer for the same channel in a different beam's pipeline. The output Z 420 of each nullformer 418 will be a boosted signal corresponding to a non-desired direction. As audio from non-desired direction may include noise, each signal Z 420 may be referred to as a noise reference signal. Thus, for each channel 1 through P the adaptive noise canceller (ANC) unit 460 calculates a noise reference signal Z 420, namely $Z_1$ 420*a* through $Z_P$ 420*p*. Thus, the noise reference signals are acquired by spatially focusing towards the various noise sources in the environment and away from the desired look-direction. The noise reference signal for channel p may thus be represented as $Z_p(k,n)$ where $Z_P$ is calculated as follows:

$$Z_p(k, n) = \sum_{m=1}^{M} \sum_{r=0}^{R} H_{NF,m}(p, r) X_m(k, n-r) \tag{2}$$

where $H_{NF,m}(p,r)$ represents the nullformer coefficients for reference channel p.

As described above, the coefficients for the nullformer filters 512 are designed to form a spatial null toward the look ahead direction while focusing on other directions, such as directions of dominant noise sources (e.g., noise source 302). The output from the individual nullformers $Z_1$ 420*a* through $Z_P$ 420*p* thus represent the noise from channels 1 through P.

The individual noise reference signals may then be filtered by noise estimation filter blocks 422 configured with weights W to adjust how much each individual channel's noise reference signal should be weighted in the eventual combined noise reference signal $\hat{Y}$ 425. The noise estimation filters (further discussed below) are selected to isolate the noise to be removed from output $Y_f$ 432. The individual channel's weighted noise reference signal $\hat{y}$ 424 is thus the channel's noise reference signal Z multiplied by the channel's weight W. For example, $\hat{y}_1=Z_1*W_1$, $\hat{y}_2=Z_2*W_2$, and so forth. Thus, the combined weighted noise estimate Y 425 may be represented as:

$$\hat{Y}_p(k, n) = \sum_{l=0}^{L} W_p(k, n, l) Z_p(k, n-l) \tag{3}$$

where $W_p(k,n,l)$ is the lth element of $W_p(k,n)$ and l denotes the index for the filter coefficient in subband domain. The noise estimates of the P reference channels are then added to obtain the overall noise estimate:

$$\hat{Y}(k, n) = \sum_{p=1}^{P} \hat{Y}_p(k, n) \tag{4}$$

The combined weighted noise reference signal $\hat{Y}$ 425, which represents the estimated noise in the audio signal, may then be subtracted from the FBF unit output $Y_f$ 432 to obtain a signal E 436, which represents the error between the combined weighted noise reference signal $\hat{Y}$ 425 and the FBF unit output $Y_f$ 432. That error, E 436, is thus the estimated desired non-noise portion (e.g., target signal portion) of the audio signal and may be the output of the adaptive noise canceller (ANC) unit 460. That error, E 436, may be represented as:

$$E(k,n)=Y(k,n)-\hat{Y}(k,n) \tag{5}$$

As shown in FIG. 4, the ABF unit output signal/Estimated Desired Signal E 436 may also be used to update the weights W of the noise estimation filter blocks 422 using sub-band adaptive filters, such as with a normalized least mean square (NLMS) approach:

$$W_p(k, n) = W_p(k, n-1) + \frac{\mu_p(k, n)}{\|Z_p(k, n)\|^2 + \varepsilon} Z_p(k, n) E(k, n) \tag{6}$$

where $Z_p(k,n)=[Z_p(k,n)\ Z_p(k,n-1)\ .\ .\ .\ Z_p(k,n-L)]^T$ is the noise estimation vector for the pth channel, $\mu_p(k,n)$ is the adaptation step-size for the pth channel, and ε is a regularization factor to avoid indeterministic division. The weights may correspond to how much noise is coming from a particular direction.

As can be seen in Equation 6, the updating of the weights W involves feedback. The weights W are recursively updated by the weight correction term (the second half of the right hand side of Equation 6) which depends on the adaptation step size, $\mu_p(k,n)$, which is a weighting factor adjustment to be added to the previous weighting factor for the filter to obtain the next weighting factor for the filter (to be applied to the next incoming signal). To ensure that the weights are updated robustly (to avoid, for example, target signal cancellation) the step size $\mu_p(k,n)$ may be modulated according to signal conditions. For example, when the desired signal arrives from the look-direction, the step-size is significantly reduced, thereby slowing down the adaptation process and avoiding unnecessary changes of the weights W. Likewise, when there is no signal activity in the look-direction, the step-size may be increased to achieve a larger value so that weight adaptation continues normally. The step-size may be greater than 0, and may be limited to a maximum value. Thus, the device may be configured to determine when there is an active source (e.g., a speaking user) in the look-direction. The device may perform this determination with a frequency that depends on the adaptation step size.

The step-size controller 404 will modulate the rate of adaptation. Although not shown in FIG. 4, the step-size controller 404 may receive various inputs to control the step size and rate of adaptation including the noise reference signals 420, the FBF unit output $Y_f$ 432, the previous step size, the nominal step size (described below) and other data. The step-size controller may calculate Equations 6-13 below. In particular, the step-size controller 404 may compute the adaptation step-size for each channel p, sub-band k, and frame n. To make the measurement of whether there is an active source in the look-direction, the device may measure a ratio of the energy content of the beam in the look direction (e.g., the look direction signal in output $Y_f$ 432) to the ratio of the energy content of the beams in the non-look directions (e.g., the non-look direction signals of noise reference signals $Z_1$ 420*a* through $Z_P$ 420*p*). This may be referred to as a beam-to-null ratio (BNR). For each subband, the device may measure the BNR. If the BNR is large, then an active source may be found in the look direction, if not, an active source may not be in the look direction.

The BNR may be computed as:

$$BNR_p(k, n) = \frac{B_{YY}(k, n)}{N_{ZZ,p}(k, n) + \delta}, k \in [k_{LB}, k_{UB}] \tag{7}$$

where, $k_{LB}$ denotes the lower bound for the subband range bin and $k_{UB}$ denotes the upper bound for the subband range bin under consideration, and δ is a regularization factor. Further, $B_{YY}(k,n)$ denotes the powers of the fixed beamformer output signal (e.g., output $Y_f$ 432) and $N_{ZZ,p}(k,n)$ denotes the powers of the pth nullformer output signals (e.g., the noise reference signals $Z_1$ 420*a* through $Z_P$ 420*p*). The powers may be calculated using first order recursive averaging as shown below:

$$B_{YY}(k,n)=\alpha B_{YY}(k,n-1)+(1-\alpha)|Y(k,n)|^2$$

$$N_{ZZ,p}(k,n)=\alpha N_{ZZ,p}(k,n-1)+(1-\alpha)|Z_p(k,n)|^2 \quad (8)$$

where, $\propto\in[0,1]$ is a smoothing parameter.

The BNR values may be limited to a minimum and maximum value as follows:

$$\mathrm{BNR}_p(k,n)\in[\mathrm{BNR}_{min},\mathrm{BNR}_{max}]$$

the BNR may be averaged across the subband bins:

$$BNR_p(n) = \frac{1}{(k_{UB}-k_{LB}+1)}\sum_{k_{LB}}^{k_{UB}} BNR_p(k, n) \quad (9)$$

the above value may be smoothed recursively to arrive at the mean BNR value:

$$\overline{\mathrm{BNR}}_p(n)=\beta\overline{\mathrm{BNR}}_p(n-1)+(1-\beta)\mathrm{BNR}_p(n) \quad (10)$$

where $\beta$ is a smoothing factor.

The mean BNR value may then be transformed into a scaling factor in the interval of [0,1] using a sigmoid transformation:

$$\xi(n) = 1 - 0.5\left(1 + \frac{v(n)}{1+|v(n)|}\right) \quad (11)$$

where $$\upsilon(n)=\gamma(\overline{\mathrm{BNR}}_p(n)-\sigma) \quad (12)$$

and $\gamma$ and $\sigma$ are tunable parameters that denote the slope ($\gamma$) and point of inflection ($\sigma$), for the sigmoid function.

Using Equation 11, the adaptation step-size for subband k and frame-index n is obtained as:

$$\mu_p(k, n) = \xi(n)\left(\frac{N_{ZZ,p}(k, n)}{B_{YY}(k, n)+\delta}\right)\mu_o \quad (13)$$

where $\mu_o$ is a nominal step-size. $\mu_o$ may be used as an initial step size with scaling factors and the processes above used to modulate the step size during processing.

At a first time period, audio signals from the microphone array 114 may be processed as described above using a first set of weights for the filters 422. Then, the error E 436 associated with that first time period may be used to calculate a new set of weights for the filters 422, where the new set of weights is determined using the step size calculations described above. The new set of weights may then be used to process audio signals from a microphone array 114 associated with a second time period that occurs after the first time period. Thus, for example, a first filter weight may be applied to a noise reference signal associated with a first audio signal for a first microphone/first direction from the first time period. A new first filter weight may then be calculated using the method above and the new first filter weight may then be applied to a noise reference signal associated with the first audio signal for the first microphone/first direction from the second time period. The same process may be applied to other filter weights and other audio signals from other microphones/directions.

The above processes and calculations may be performed across sub-bands k, across channels p and for audio frames n, as illustrated in the particular calculations and equations.

The estimated non-noise (e.g., output) audio signal E 436 may be processed by a synthesis filterbank 428 which converts the signal 436 into time-domain beamformed audio data Z 450 which may be sent to a downstream component for further operation. As illustrated in FIG. 6, there may be one component audio signal E 436 for each beam, thus for B beams there may be B audio signals E 436. Similarly, there may be one stream of beamformed audio data Z 450 for each beam, thus for B beams there may be B beamformed audio signals B 450. For example, a first beamformed audio signal may correspond to a first beam and to a first direction, a second beamformed audio signal may correspond to a second beam and to a second direction, and so forth.

As shown in FIGS. 4 and 6, the input audio data from a microphone array may include audio data 411 for each microphone 0 through M in the time domain, which may be converted by the analysis filterbank into spectral domain audio signals X 413 for each microphone 0 through M. The beamformer unit may then convert the audio signals X 413 into beamformer output signals E 436 in the spectral domain, with one signal for each beam 0 through B. The synthesis filterbank may then may convert the signals E 436 into time domain beamformer audio data Z 450, with one set of audio data Z 450 for each beam 0 through B.

Figure 7A:
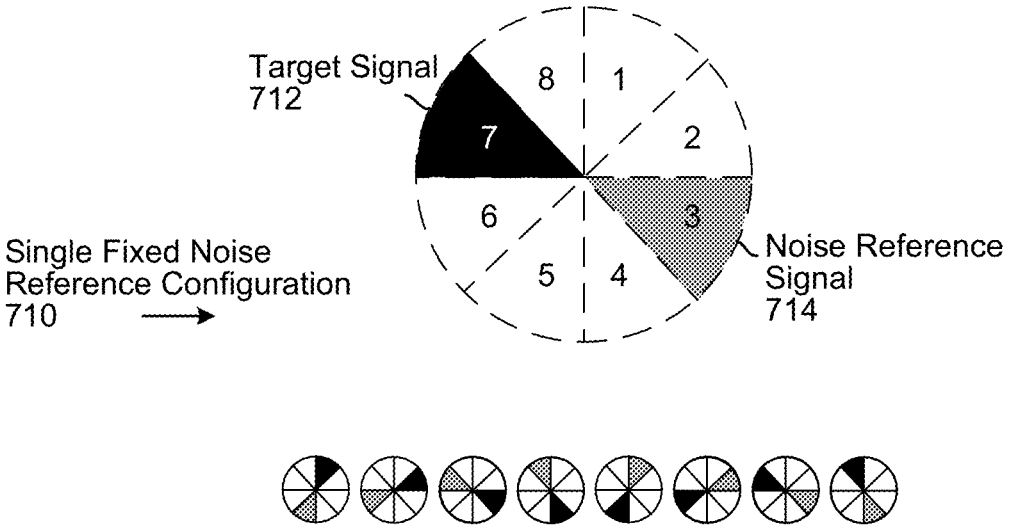
FIGS. 7A-7B illustrate examples of noise reference signals according to embodiments of the present disclosure.
Figure 7A:
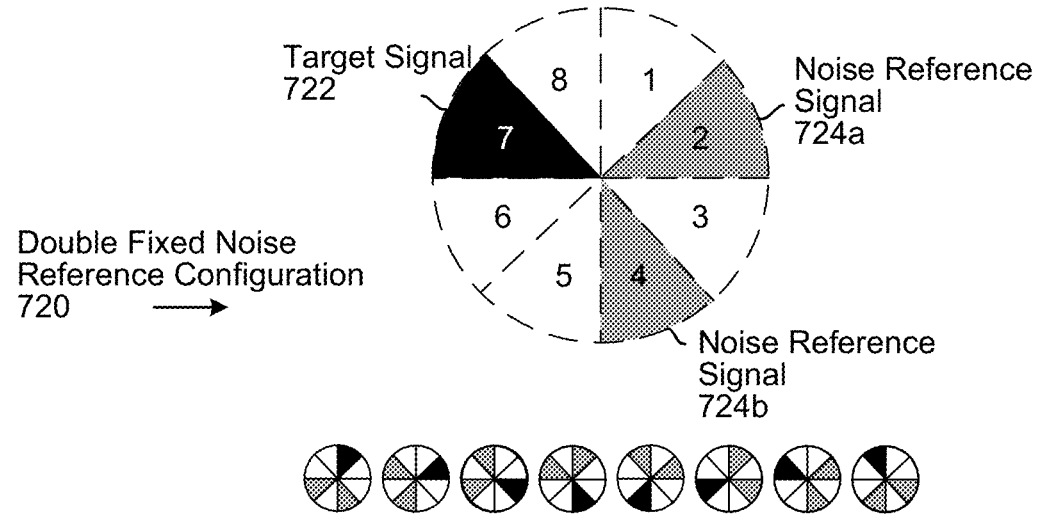
Figure 7B:
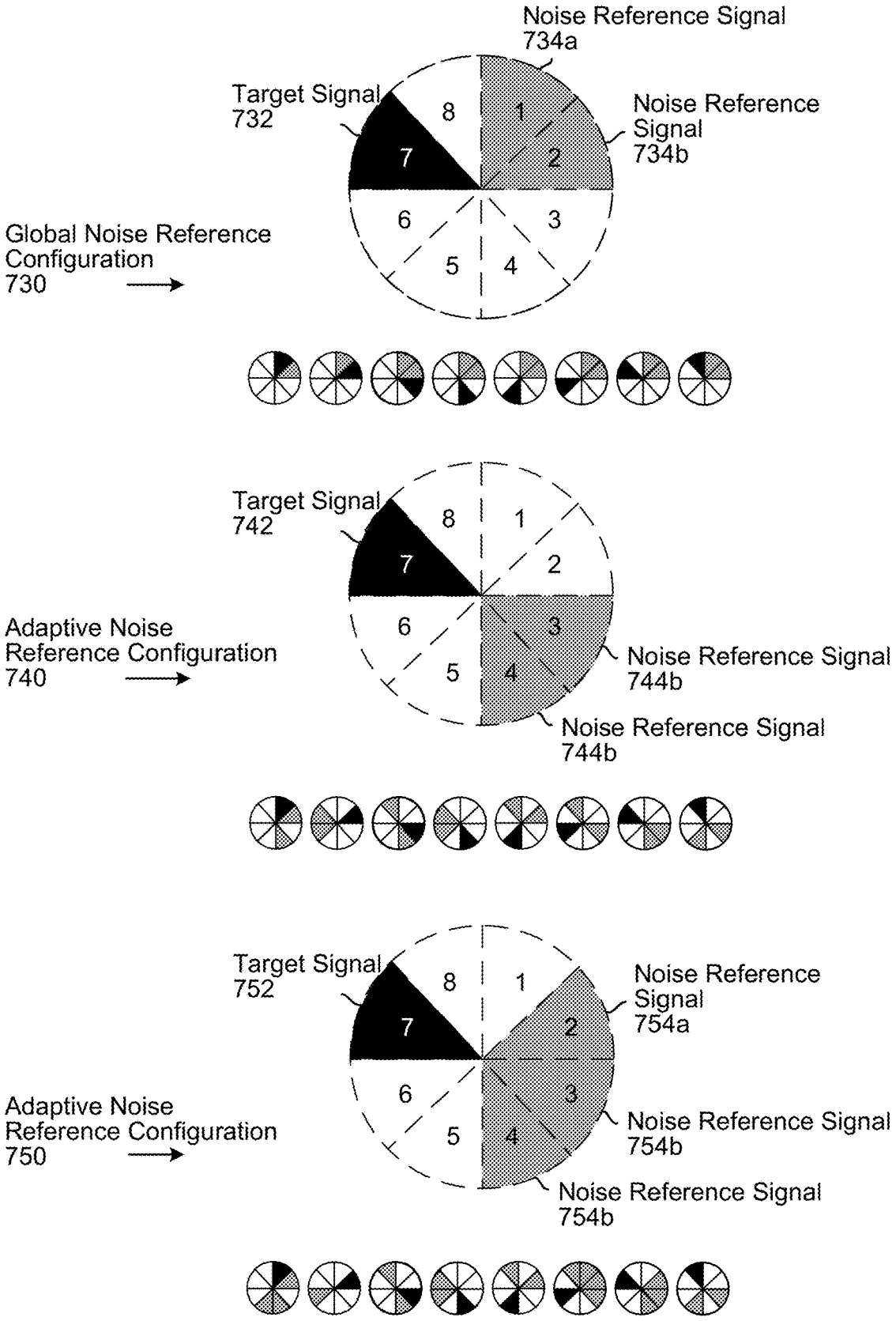

FIGS. 7A-7B illustrate examples of noise reference signals according to embodiments of the present disclosure. The device 110 may determine the noise reference signal(s) using a variety of techniques. In some examples, the device 110 may use the same noise reference signal(s) for each of the directional outputs. For example, the device 110 may select a first directional output associated with a particular direction as a noise reference signal and may determine the signal quality metric for each of the directional outputs by dividing a power value associated with an individual directional output by a power value associated with the first directional output (e.g., noise power level). Thus, the device 110 may determine a first signal quality metric by dividing a first power level associated with a second directional output by the noise power level, may determine a second signal quality metric by dividing a second power level associated with a third directional output by the noise power level, and so on. As the noise reference signal is the same for each of the directional outputs, instead of determining a ratio the device 110 may use the power level associated with each of the directional outputs as the signal quality metrics.

In some examples, each directional output may be associated with unique noise reference signal(s). To illustrate an example, the device 110 may determine the noise reference signal(s) using a fixed configuration based on the directional output. For example, the device 110 may select a first directional output (e.g., Direction 1) and may choose a second directional output (e.g., Direction 5, opposite Direction 1 when there are eight beams corresponding to eight different directions) as a first noise reference signal for the first directional output, may select a third directional output (e.g., Direction 2) and may choose a fourth directional output (e.g., Direction 6) as a second noise reference signal for the third directional output, and so on. This is illustrated in FIG. 7A as a single fixed noise reference configuration 710.

As illustrated in FIG. 7A, in the single fixed noise reference configuration 710, the device 110 may select a seventh directional output (e.g., Direction 7) as a target signal 712 and select a third directional output (e.g., Direction 3) as a noise reference signal 714. The device 110 may continue this pattern for each of the directional outputs, using Direction 1 as a target signal and Direction 5 as a noise reference signal, Direction 2 as a target signal and Direction 6 as a noise reference signal, Direction 3 as a target signal and Direction 7 as a noise reference signal, Direction 4 as a target signal and Direction 8 as a noise reference signal, Direction 5 as a target signal and Direction 1 as a noise reference signal, Direction 6 as a target signal and Direction 2 as a noise reference signal, Direction 7 as a target signal and Direction 3 as a noise reference signal, and Direction 8 as a target signal and Direction 4 as a noise reference signal.

As an alternative, the device 110 may use a double fixed noise reference configuration 720. For example, the device 110 may select the seventh directional output (e.g., Direction 7) as a target signal 722 and may select a second directional output (e.g., Direction 2) as a first noise reference signal 724*a* and a fourth directional output (e.g., Direction 4) as a second noise reference signal 724*b*. The device 110 may continue this pattern for each of the directional outputs, using Direction 1 as a target signal and Directions 4/6 as noise reference signals, Direction 2 as a target signal and Directions 5/7 as noise reference signals, Direction 3 as a target signal and Directions 6/8 as noise reference signals, Direction 4 as a target signal and Directions 7/9 as noise reference signal, Direction 5 as a target signal and Directions 8/2 as noise reference signals, Direction 6 as a target signal and Directions 1/3 as noise reference signals, Direction 7 as a target signal and Directions 2/4 as noise reference signals, and Direction 8 as a target signal and Directions 3/5 as noise reference signals.

While FIG. 7A illustrates using a fixed configuration to determine noise reference signal(s), the disclosure is not limited thereto. FIG. 7B illustrates examples of the device 110 selecting noise reference signal(s) differently for each target signal. As a first example, the device 110 may use a global noise reference configuration 730. For example, the device 110 may select the seventh directional output (e.g., Direction 7) as a target signal 732 and may select the first directional output (e.g., Direction 1) as a first noise reference signal 734*a* and the second directional output (e.g., Direction 2) as a second noise reference signal 734*b*. The device 110 may use the first noise reference signal 734*a* and the second noise reference signal 734*b* for each of the directional outputs (e.g., Directions 1-8).

As a second example, the device 110 may use an adaptive noise reference configuration 740, which selects two directional outputs as noise reference signals for each target signal. For example, the device 110 may select the seventh directional output (e.g., Direction 7) as a target signal 742 and may select the third directional output (e.g., Direction 3) as a first noise reference signal 744*a* and the fourth directional output (e.g., Direction 4) as a second noise reference signal 744*b*. However, the noise reference signals may vary for each of the target signals, as illustrated in FIG. 7B.

As a third example, the device 110 may use an adaptive noise reference configuration 750, which selects one or more directional outputs as noise reference signals for each target signal. For example, the device 110 may select the seventh directional output (e.g., Direction 7) as a target signal 752 and may select the second directional output (e.g., Direction 2) as a first noise reference signal 754*a*, the third directional output (e.g., Direction 3) as a second noise reference signal 754*b*, and the fourth directional output (e.g., Direction 4) as a third noise reference signal 754*c*. However, the noise reference signals may vary for each of the target signals, as illustrated in FIG. 7B, with a number of noise reference signals varying between one (e.g., Direction 6 as a noise reference signal for Direction 2) and four (e.g., Directions 1-3 and 8 as noise reference signals for Direction 6).

In some examples, the device 110 may determine a number of noise references based on a number of dominant audio sources. For example, if someone is talking while music is playing over loudspeakers and a blender is active, the device 110 may detect three dominant audio sources (e.g., talker, loudspeaker, and blender) and may select one dominant audio source as a target signal and two dominant audio sources as noise reference signals. Thus, the device 110 may select first audio data corresponding to the person speaking as a first target signal and select second audio data corresponding to the loudspeaker and third audio data corresponding to the blender as first reference signals. Similarly, the device 110 may select the second audio data as a second target signal and the first audio data and the third audio data as second reference signals, and may select the third audio data as a third target signal and the first audio data and the second audio data as third reference signals.

Additionally or alternatively, the device 110 may track the noise reference signal(s) over time. For example, if the music is playing over a portable loudspeaker that moves around the room, the device 110 may associate the portable loudspeaker with a noise reference signal and may select different portions of the beamformed audio data based on a location of the portable loudspeaker. Thus, while the direction associated with the portable loudspeaker changes over time, the device 110 selects beamformed audio data corresponding to a current direction as the noise reference signal.

While some of the examples described above refer to determining instantaneous values for a signal quality metric (e.g., SIR, SNR, or the like), the disclosure is not limited thereto. Instead, the device 110 may determine the instantaneous values and use the instantaneous values to determine average values for the signal quality metric. Thus, the device 110 may use average values or other calculations that do not vary drastically over a short period of time in order to select which signals on which to perform additional processing. For example, a first audio signal associated with an audio source (e.g., person speaking, loudspeaker, etc.) may be associated with consistently strong signal quality metrics (e.g., high SIR/SNR) and intermittent weak signal quality metrics. The device 110 may average the strong signal metrics and the weak signal quality metrics and continue to track the audio source even when the signal quality metrics are weak without departing from the disclosure.

As discussed above, electronic devices may perform acoustic echo cancellation and/or adaptive interference cancellation to remove and/or attenuate an echo signal captured in the input audio data. For example, the device 110 may capture both desired audio (e.g., speech intended for speech processing) and undesired audio through its microphones. To indicate to the system when speech is intended for speech processing, the device 110 and/or other components of the system may be configured with a wakeword/wake command detector. Thus the device may detect when a user activates a virtual assistant by speaking a wakeword corresponding to the assistant while near a voice-enabled device and/or by making a gesture such as a button press or other non-verbal movement detectable by the device. The device may render an audible or visual indication of the invoked assistant to inform the user that a virtual assistant is active (e.g., processing incoming audio data for speech processing purposes). Audible indications may include synthetic speech having a recognizable speech style and/or a distinct sound such as an earcon (e.g., distinctive beep/audible tone). Visual indication may include a light color/pattern emitted from the device and/or an image such as a voice icon displayed on an electronic display of the device. The device 110 may thus receive audio corresponding to a spoken natural language input originating from the user. The device 110 may process audio following detection of a wakeword.

The device 110 may be configured with a wakeword detector. The wakeword detector processes data to detect a representation of a wakeword. Depending on system configuration, the wakeword detector may operate on raw audio data, processed audio data, post-beamformed audio data, etc. The wakeword detector may be configured to detect one or more wakewords for example "Alexa," "Echo," "Computer," etc. Similarly, detection of certain wakeword(s) may activate a first assistant while detection of other wakewords (e.g., "Hey Siri," "Ok Google,") may activate one or more different assistants. The wakeword detector of the device 110 may process audio data, representing the audio, to determine whether speech is represented therein. The device 110 may use various techniques to determine whether the audio data includes speech. In some examples, the device 110 may apply voice-activity detection (VAD) techniques. Such techniques may determine whether speech is present in audio data based on various quantitative aspects of the audio data, such as the spectral slope between one or more frames of the audio data; the energy levels of the audio data in one or more spectral bands; the SNRs of the audio data in one or more spectral bands; or other quantitative aspects. In other examples, the device 110 may implement a classifier configured to distinguish speech from background noise. The classifier may be implemented by techniques such as linear classifiers, support vector machines, and decision trees. In still other examples, the device 110 may apply hidden Markov model (HMM) or Gaussian mixture model (GMM) techniques to compare the audio data to one or more acoustic models in storage, which acoustic models may include models corresponding to speech, noise (e.g., environmental noise or background noise), or silence. Still other techniques may be used to determine whether speech is present in audio data.

Wakeword detection is typically performed without performing linguistic analysis, textual analysis, or semantic analysis. Instead, the audio data, representing the audio, is analyzed to determine if specific characteristics of the audio data match preconfigured acoustic waveforms, audio signatures, or other data corresponding to a wakeword.

Thus, the wakeword detection component may compare audio data to stored data to detect a wakeword. One approach for wakeword detection applies general large vocabulary continuous speech recognition (LVCSR) systems to decode audio signals, with wakeword searching being conducted in the resulting lattices or confusion networks. Another approach for wakeword detection builds HMMs for each wakeword and non-wakeword speech signals, respectively. The non-wakeword speech includes other spoken words, background noise, etc. There can be one or more HMMs built to model the non-wakeword speech characteristics, which are named filler models. Viterbi decoding is used to search the best path in the decoding graph, and the decoding output is further processed to make the decision on wakeword presence. This approach can be extended to include discriminative information by incorporating a hybrid DNN-HMM decoding framework. In another example, the wakeword detection component may be built on deep neural network (DNN)/recursive neural network (RNN) structures directly, without HMM being involved. Such an architecture may estimate the posteriors of wakewords with context data, either by stacking frames within a context window for DNN, or using RNN. Follow-on posterior threshold tuning or smoothing is applied for decision making. Other techniques for wakeword detection, such as those known in the art, may also be used.

Once the wakeword is detected by the wakeword detector and/or a wake command is detected by a wake command detector, the device 110 may "wake" and begin transmitting audio data, representing the audio, to a remote/cloud system and/or other component for purposes of performing speech processing which may include, for example, automatic speech recognition, natural language processing, etc. The audio data may include data corresponding to the wakeword; in other embodiments, the portion of the audio corresponding to the wakeword may or may not be removed by the device 110 prior to sending the audio data for speech processing. In the case of touch input detection or gesture based input detection, the audio data may not include a wakeword.

Figure 8:
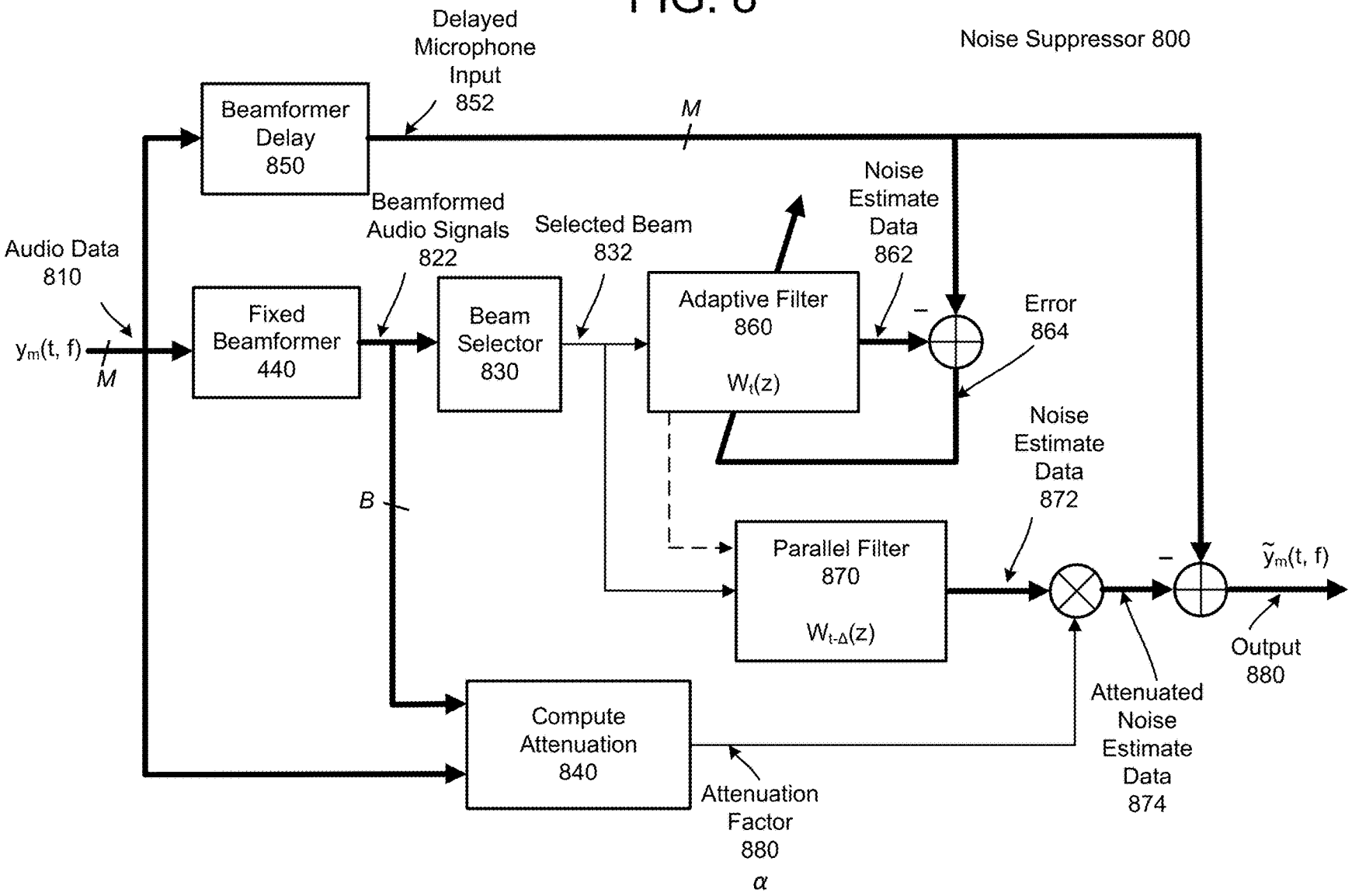
FIG. 8 illustrates an example architecture for performing noise-cancelling according to embodiments of the present disclosure

Referring now to FIG. 8, in order to improve device operation and microphone noise suppression, a configuration for noise suppression (e.g., noise suppressor 800) including various components is shown. The noise suppressor 800 may be implemented to reduce noise from the microphone input (e.g., audio data 810) of the microphone array (e.g., microphone array 114) as shown in FIG. 2. While typical noise suppression techniques may deteriorate a fixed relationship between microphones, the techniques and features described in the present disclosure may facilitate noise suppression such that the fixed relationship between the microphones (e.g., microphones 202*a*-202*h*) is preserved.

The noise suppressor 800 may include various components as shown in FIG. 8 and as will be described herein, however not all the components shown in FIG. 8 are required and in some implementations and embodiments, one or more of the components as shown in FIG. 8 are not included. The noise suppressor may take as input the audio data 810. The audio data 810 may include a number of audio signals y where each signal may correspond to a particular time t and represent particular frequency data f. Further, there may be M signals as part of the audio data 810, where M represents the number of microphones in the microphone array. Thus the input audio data 810 may be represented as $y_m(t, f)$. The audio data 810 may include frequency domain audio data (e.g., 413) such as that output by the analysis filterbank 410. Alternatively, the audio data 810 may include time domain audio data (e.g., 411) such as that output by the microphone array 114. The specific audio data 810 may depend on system configuration. The noise suppressor 800 may include the FBF 440. The FBF 440 may thus receive audio data 810 (e.g., audio data) and determine beamformed audio signals 822.

As discussed above, there may be one component audio signal for each beam. Thus, for B beams there may be B audio signals. The number of beams B may be different than the number of microphones M. For example, a first beamformed audio signal may correspond to a first beam and to a first direction, a second beamformed audio signal may correspond to a second beam and to a second direction, and so forth. In this way, the FBF 440 may "look" in each corresponding direction around the device and the noise suppressor 800 may determine a direction from which the noise emanates, select that direction as the noise source, adaptively estimate how much of the noise is received from that direction, and remove (e.g., suppress or cancel) the noise.

One or more conditions may be applied to determine how much noise suppression is applied or if noise suppression is applied at all. For example, if the audio signal received by the microphones is of sufficient quality (for example as determined by a signal quality metric), noise suppression or cancellation may not be applied. Further, if the directivity of the noise is wide (e.g., the noise is diffuse or spread out in the room), the amount of noise suppression may be based on sound conditions around the device. Thus, instead of purely estimating and removing directional noise from the microphone input as may typically be done, the techniques and features described in the present disclosure may be implemented to control the amount of diffuse noise removed from the microphone input.

The beamformed audio signals 822 may be received by the beam selector 830 which may apply logic to select the desired beam (sometimes called the "look beam" or "look direction") which in this case represents the likely direction from which a noise source is detected. For example, the beam selector 830 may determine that first and second audio signals of the beamformed audio signals 822 include first and second representations, respectively, of first acoustic noise. The first acoustic noise may emanate from a noise source (e.g., the noise source 302 of FIG. 3C). Further, the beam selector 830 may determine that the first representation of the first acoustic noise corresponds to a higher energy level than the second representation of the first acoustic noise. The beam selector 830 may select an audio signal, which may correspond to a beam and be referred to as the selected beam, reference signal, or reference, based on the first representation of the first acoustic noise corresponding to the higher energy level.

The beam selector 830 may be configured to select a beam corresponding to an audio signal representative of a noise source. As a frequency component of the noise source may change often, one beam may best represent the noise source in one time interval and another beam may best represent the noise source in the next time interval. Thus, the logic of the beam selector 830 may be configured to keep the selected beam steady without switching the selected beam at every time interval, for example. This is because when the selected beam is switched too often, there may not be enough time for the adaptive filter (e.g., the adaptive filter 860) of the system to re-converge, and the adaptive filter coefficients may continue changing quickly, thus degrading the system's performance. As a result, it may be undesirable to switch the selected beam in a continuous manner due to small changes in the noise condition of the area (e.g., as the noise source moves or gets louder).

In some embodiments, the beam selector 830 may be configured to keep the selected beam as steady as possible while also having the ability to switch the selected beam in response to bigger changes in the noise condition of the area. For example, in some situations the device 110 and/or the microphone array 114 may rotate or move (for example as part of a device that is moved by a user or itself is capable of movement), thereby changing a beam scenario (e.g., such as the beam scenario depicted in FIG. 3C). It may be desirable for the beam selector 830 to be configured to switch the selected beam only if the device 110 or microphone array 114 rotates or moves significantly rather than for small changes in beam energy from one beam to another. Further, if a previously selected beam (e.g., selected at a first time interval) is adjacent to another beam determined by the beam selector 830 to subsequently have a higher beam energy level (e.g., at a second time interval), the beam selector 830 may be configured not to switch the selected beam and keep the beam steady.

In some embodiments, the beam selector 830 may receive movement data for the device 110 (e.g., as the device 110 or microphone array 114 moves or rotates). If the beam energies do not change significantly, the beam selector 830 may not switch the selected beam. If the beam energies change significantly (e.g., greater than a configurable beam energy threshold), the beam selector 830 may switch the selected beam.

Figure 9:
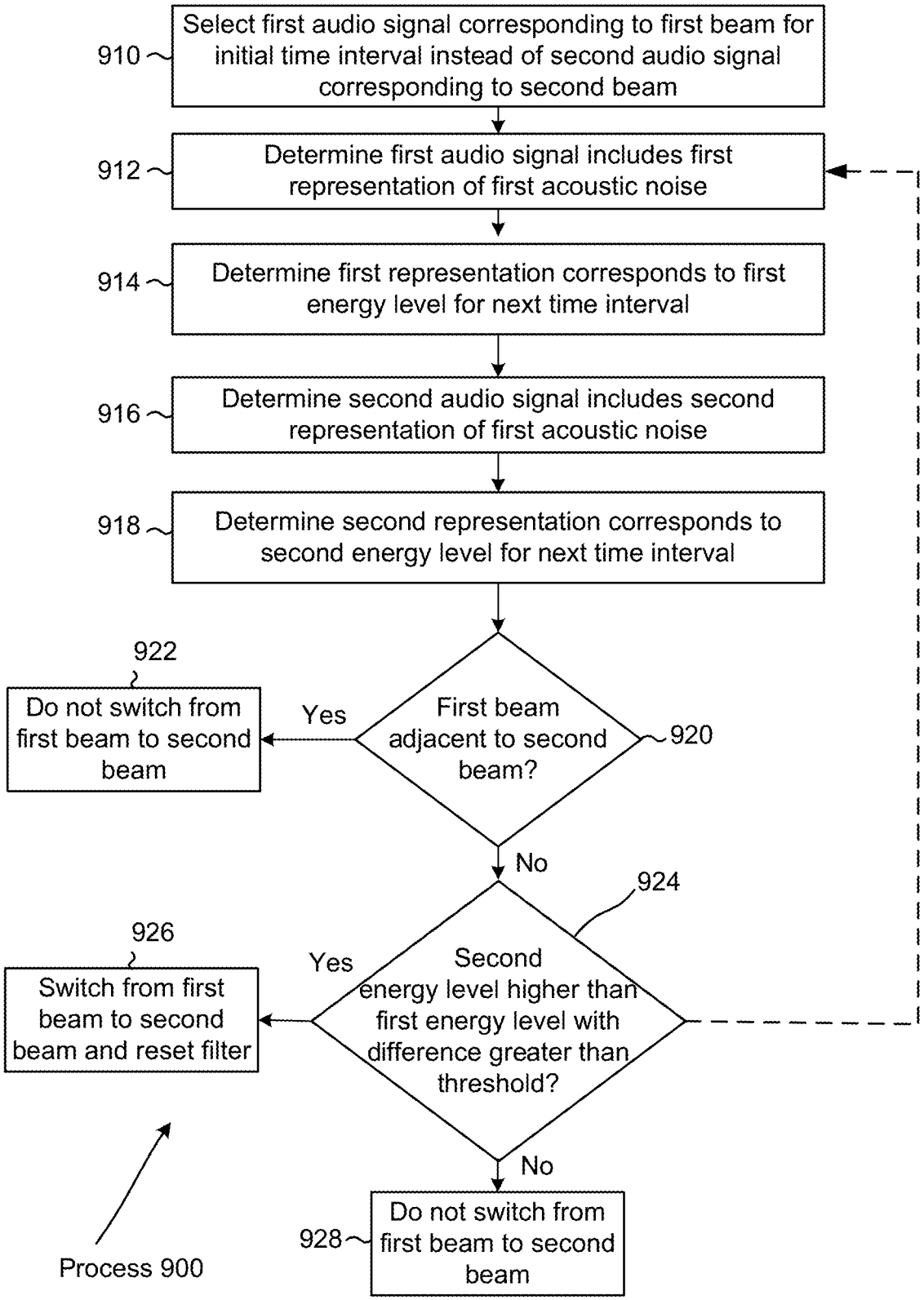
FIG. 9 is a flowchart conceptually illustrating an example method for beam switching according to embodiments of the present disclosure.

Referring now to FIG. 9, a flowchart conceptually illustrating an example method for beam switching according to embodiments of the present disclosure is shown. A process 900 may be implemented via the beam selector 830. The process may include selecting (910) a first audio signal (e.g., from the beamformed audio signals 822) corresponding to a first beam (e.g., corresponding to direction 5 as shown in FIG. 3C) for an initial time interval instead of a second audio signal (e.g., from the beamformed audio signals 822) corresponding to a second beam (e.g., corresponding to direction 6 as shown in FIG. 3C). The first audio signal may be initially selected (e.g., at an initial time frame) as the reference beam by the beam selector 830 because the first audio signal may correspond to a representation of acoustic noise (e.g., from noise source 302) that may correspond to a higher energy level than another representation of the acoustic noise corresponding to the second audio signal.

Further, the process 900 may include determining (912) that the first audio signal includes a first representation of first acoustic noise associated with a next time interval later than the initial time interval. The process 900 may also include determining (914) that the first representation of the first acoustic noise corresponds to a first energy level associated with the next time interval. The process 900 may additionally include determining (916) that the second audio signal includes a second representation of the first acoustic noise associated with the next time interval. Moreover, the process 900 may additionally include determining (918) that the second representation of the first acoustic noise corresponds to a second energy level associated with the next time interval.

Furthermore, the process 900 may include determining (920) whether the first beam (e.g., corresponding to direction 5 as shown in FIG. 3C) corresponding to the first audio signal is adjacent to the second beam (e.g., corresponding to direction 6 as shown in FIG. 3C) corresponding to the second audio signal. If the first beam is adjacent to the second beam, the process 900 may include determining (922) not to switch the selected beam from the first beam to the second beam (e.g., not selecting the second audio signal corresponding to the second beam as the reference beam). If the first beam is not adjacent to the second beam, the process 900 may include determining to switch the selected beam from the first beam to the second beam (e.g., selecting the second audio signal corresponding to the second beam as the reference beam) based on further information.

For example, the process 900 may include determining (924) whether the second energy level (e.g., corresponding to the second representation of the second acoustic noise) is higher than the first energy level (e.g., corresponding to the first representation of the first acoustic noise). If the second energy level is higher than the first energy level and the difference between the second energy level and the first energy level is greater than a configurable threshold, the process 900 may include determining (926) to switch the selected beam from the first beam to the second beam and resetting the adaptive filter 860. The configurable threshold may be set such that the second energy level must be significantly higher (e.g., above a threshold) than the first energy level in order to determine to switch the selected beam from the first beam to the second beam. If the second energy level is higher not than the first energy level, the process 900 may include determining (928) not to switch the selected beam from the first beam to the second beam.

As discussed above, the fixed FBF 440 may generate a set of beams (e.g., beamformed audio signals 822) and the reference beam or signal may correspond to the beamformed audio signal with highest energy. Thus, the reference signal may be driven by the beamformed audio signal with highest energy. In the absence of a target signal (e.g., corresponding to desired speech such as a wakeword), the beamformed signal with highest energy may be a good linear estimate of an interference signal (e.g., corresponding to noise). The direction of the reference signal may be determined in the absence of the target signal, and, as explained in further detail below, the same direction may be used with a delayed filter where updating of the filter coefficient values is delayed as the target signal (e.g., corresponding to the wakeword is received.

The time delay for updating the filter coefficient values of the delayed filter (which may be referred to as the parallel filter) may correspond to a length of time it takes to utter the wakeword. In other words, at a time of detecting the wakeword, the beamformed signal with the highest energy may correspond to a direction from which the wakeword emanates and audio received prior to detection of the wakeword may be treated as noise. Implementation of the delayed filter may allow the noise suppressor 800 to assume that the audio coming from the direction with the highest energy before the device 110 detects the wakeword is noise, that audio received during the time delay is representative of the wakeword, and that audio received after the time delay (e.g., after the wakeword) is noise and desired audio (e.g., speech) that can be processed using data (such as filter coefficients) that were calculated before the wakeword was detected. Thus the noise suppressor may operate as if audio received after the time delay is noise that can be processed using data (such as filter coefficients) that were calculated before the wakeword was detected. In this way the system may remove the pre-wakeword noise from the post-wakeword noise plus speech.

To prevent frequent beam switching, hysteresis data may be used by scaling up the determined energy of the previously selected beam (e.g., the previously selected beamformed audio signal). Selecting the best beam (e.g., the selected beam 832) for a time frame or interval may include the following operations:

Initialize a beam count Ω for each beam as:

$$\Omega_k(t)=0,\forall,k \tag{14}$$

At each time frame or interval t, determine a highest energy beam k with the hysteresis data as described above. Set the beam counter for time frame t as:

$$\Omega_k(t)=\delta(k-\bar{k}) \tag{15}$$

where δ(.) is the dirac delta function. The best beam at time frame t may be determined as:

$$\hat{k}(t) = \operatorname{argmax} \sum_{\tau=t-\Delta}^{t} \Omega_k(\tau) \tag{16}$$

If the index of the strongest beam $\bar{k}(t)$ changes, then $W_t(z)$ (the adaptive filter coefficient values as described below) is reset to zero if:

$$|\theta_{\hat{k}(t)}-\theta_{\hat{k}(t-1)}|>\theta_o \tag{17}$$

where $\theta_k$ is the a look angle of beam k and $\theta_o$ is a reset threshold, which may, for example, be about 20°.

As described above, while a beamformed signal (e.g., the selected beam 832) may be selected as the reference signal and used to suppress noise at the microphone input, this may distort the target signal. The techniques and features described in the present disclosure may mitigate the impact on the target signal from noise suppression.

Downstream components of the noise suppressor 800 may use the selected beam 832 as a reference beam. For example, the adaptive filter 860 of the noise suppressor 800 may determine a filter coefficient value (e.g., $W_t(z)$) for each microphone (which may be different) based on the selected beam 832 and an error 864. Further, the adaptive filter 860 may process the audio signal corresponding to the selected beam 832 (the "reference") and the error 864 to determine noise estimate data 862. The error 864 may be the noise estimate data 862 subtracted from delayed microphone input 852. A beamformer delay component 850 may be used to delay the microphone input (e.g., input audio data 810) so that the eventual output signal 880 is based on the input audio data from one audio frame or interval as compared to the attenuated noise estimate data from that same appropriate audio frame or interval. (It would be undesirable to subtract noise estimate data of one frame from raw audio data of a different frame.) The length of the delay may be based on how long it takes the components of noise suppressor 800 to operate, for example how long FBF 440 takes to process the microphone input. Thus, the adaptive filter 860 may process the reference and the error 864 to determine the noise estimate data 862, which is subtracted from the delayed microphone input 852 to update the error 864. In this way, the adaptive filter 860 adapts (e.g., determines and updates) filter coefficient values (e.g., $W_t(z)$) as new microphone input (e.g., input audio data 810) is received at the microphones (e.g., at time frame t).

Rather than directly using the error 864 as an output of the noise suppressor 800, a parallel filter 870 similar to adaptive filter 860 but without the adaptive feature (e.g., a fixed or semi-fixed filter updated less frequently) may be used to process the reference to determine noise estimate data 872. For example, a transfer function of the parallel filter 870 may correspond to previous filter coefficient values (e.g., $W_{t-\Delta}(z)$) determined by the adaptive filter 860. By using a previous transfer function corresponding to previous filter coefficient values (corresponding to time t−Δ), the noise suppressor 800 may avoid issues related to an adaptive filter (e.g., the adaptive filter 860) that updates filter coefficient values (e.g., $W_t(z)$) and applies them to an actual signal of interest (e.g., corresponding to desired speech such as a wakeword), rather than a noise signal. Thus a delay Δ may represent the difference between a current time/audio interval and a previous time/audio interval whose filter values are used to determine the noise estimate data. Accordingly, to process audio data of time t, the filter coefficient values from time t−Δ may be used so that audio received prior to detection of the wakeword can be treated as noise to be suppressed. Audio received during the delay may be representative of the target signal (e.g., corresponding to the wakeword) should not be suppressed.

Thus, the filter coefficient values determined by the adaptive filter 860 may be passed to the parallel filter 870 and may be used to by the parallel filter 870 to process the reference while the adaptive filter 860 updates the filter coefficient values based on the reference and the delayed microphone input 852. In some implementations, the filter coefficient values used by the parallel filter 870 at one time interval may be based on filter coefficient values determined by the adaptive filter 860 in one or more previous time intervals. A history of the filter coefficient values determined by the adaptive filter 860 may be used to determine the filter coefficient values used by the parallel filter 870. For example, the filter coefficient values used by the parallel filter 870 may be determined based on an average of one or more filter coefficient values previously determined by the adaptive filter 860.

A time delay Δ for updating the filter coefficient values of the parallel filter 870 (e.g., $W_{t-\Delta}(z)$) may protect against potential interference due to possible double-talk. As described above, the desired speech may be a wakeword. The time delay may allow for using the filter coefficient values determined by the adaptive filter 860 before the wakeword is uttered (e.g., via the parallel filter 870. The time delay may be configured to prevent the noise suppressor 800 from suppressing or cancelling microphone input that corresponds to the utterance of the wakeword and may be implemented via the parallel filter 870. The filter coefficient values from time t−Δ may be used so that audio received prior to detection of the wakeword can be treated as noise to be suppressed. Audio received during the delay may be representative of the wakeword and, as the target signal, should not be suppressed. In other words, the parallel filter 870, without the update of filter coefficient values from adaptive filter 860, may be used in case a user utters the wakeword, such that the microphone input corresponding to the wakeword is not suppressed or cancelled.

The duration of the time delay may correspond to the duration of the target signal, which, for example, may be an estimate of the length of time it takes to utter the wakeword. The time delay may be a configurable parameter and in some situations may be set to about 500 milliseconds. If the target signal is longer (e.g., a longer wakeword), then the parameter of the time delay may be longer. The time delay may be configured based on a particular wakeword that is activated for the device, as the device may respond to multiple wakewords. The time delay may be configured based on one or more active wakewords for the device. Setting the time delay in this manner allows the pre-speech filter coefficients (e.g., coefficients calculated when only noise was detected) to be used to cancel out the noise from the audio detected after the wakeword, which may correspond to the noise plus speech. In this way the system may remove the pre-wakeword noise from the post-wakeword noise plus speech.

After the reference is processed with the parallel filter 870 to determine noise estimate data 872, an attenuation factor may be applied by an attenuation computation block 840 to determine attenuated noise estimate data 874. The attenuation factor 880 (e.g., a) may be used to scale down the noise estimate data 872. The noise estimate data 872 may include noise estimate data for each microphone, however the attenuation factor may be the same for each microphone and may be applied equally to noise estimate data 872 for each microphone. The attenuated noise estimate data 874 may be subtracted from the delayed microphone input 852 to determine output 880 (e.g., output audio data).

The attenuation factor 880 may allow for flexibility and control of the trade-off between signal quality improvement and target signal distortion. The larger the attenuation factor, the bigger the signal quality improvement may be, but the possibility of greater distortion may also increase. Similarly, the smaller the attenuation factor, the smaller the signal quality improvement may be, but the possibility of greater distortion may decrease. A maximum attenuation factor (e.g. a gain limit as described below) may control the noise suppression level.

Several criteria may be used to determine the attenuation factor by the attenuation computation block 840. The attenuation factor may be based on the audio data 810 (e.g., input audio data received from the microphone array) and the beamformed audio signals 822. In some implementations, the attenuation factor may be based on a signal quality metric value (e.g., SNR) associated with the first audio data and the second audio data, a diffuseness associated with the first audio signal and the second audio signal (e.g., a diffusion factor), and/or a gain limit For example, if the signal quality metric value (e.g., SNR) at the microphone input is high, the attenuation factor may be reduced. Similarly, if the signal quality at the microphone input is low, the attenuation factor may be increased. The particular attenuation factor used may depend on the application for which the noise suppressor is used and/or the desired signal quality.

Further, if the noise to be suppressed is diffuse in the area of the device, the attenuation factor may be reduced. Similarly, if the noise to be suppressed has directivity (e.g., comes from one direction), the attenuation factor may be increased. For diffuse noise, selecting a single beam as a reference signal may not be effective for characterizing the direction of the noise. An indicator of noise diffuseness may be a ratio between a maximum and minimum energy of different beams (e.g., the beamformed signals 822) and may be referred to as a diffusion factor. In an implementation, for every time frame or interval t, the maximum and minimum beam energies for each beam may be measured. If the difference in beam energies for each beam is high, it may be an indication that the noise source is directive. If all the beams have similar energies, it may be an indication that the noise is diffuse. The noise suppressor 800 may be most effective at suppressing noise from noise sources that are directive.

The attenuation factor at time frame t, α(t) may be determined as:

$$\alpha(t) = \Gamma\left(1 - \frac{\gamma(t)}{\gamma\max}\right) \cdot \Gamma\left(\frac{\max\{\lambda\}}{\min\{\lambda\}}\right) \cdot \alpha_{max} \tag{18}$$

where Γ(.) is a sigmoid function, γ(t) is the SNR at time frame t, and λ is a vector whose entries are the smoothed energy of the fixed beamformer beams (e.g., beamformed audio signals 822).

The SNR (or other signal quality metric value) may be determined based on the microphone input. A gain limit $\alpha_{max}$ for the attenuation factor may be applied to allow further control of the attenuation factor. The gain limit may be a tuning parameter such as a hyperparameter for the attenuation factor. In some implementations, the maximum gain limit may be one and the ideal gain limit may be a value of one, but other maximum values for the gain limit may be used. Determination of the gain limit may be based on various factors to allow degrees of freedom for the gain limit, including room conditions and device-specific factors. In some implementations, the gain limit may be determined experimentally by testing values for the gain limit.

The noise suppression system described herein may be most effective if the position of the noise source does not change significantly with respect to the device during utterance of the wakeword. The system may be designed to track the noise source in the absence of target signal and exploit that acquired noise source information to suppress interference by the noise source in the presence of the target signal (e.g., corresponding to the utterance of the wakeword). It should be noted that the noise suppression system may be configured to operate in either the time domain or the frequency domain.

Figure 10:
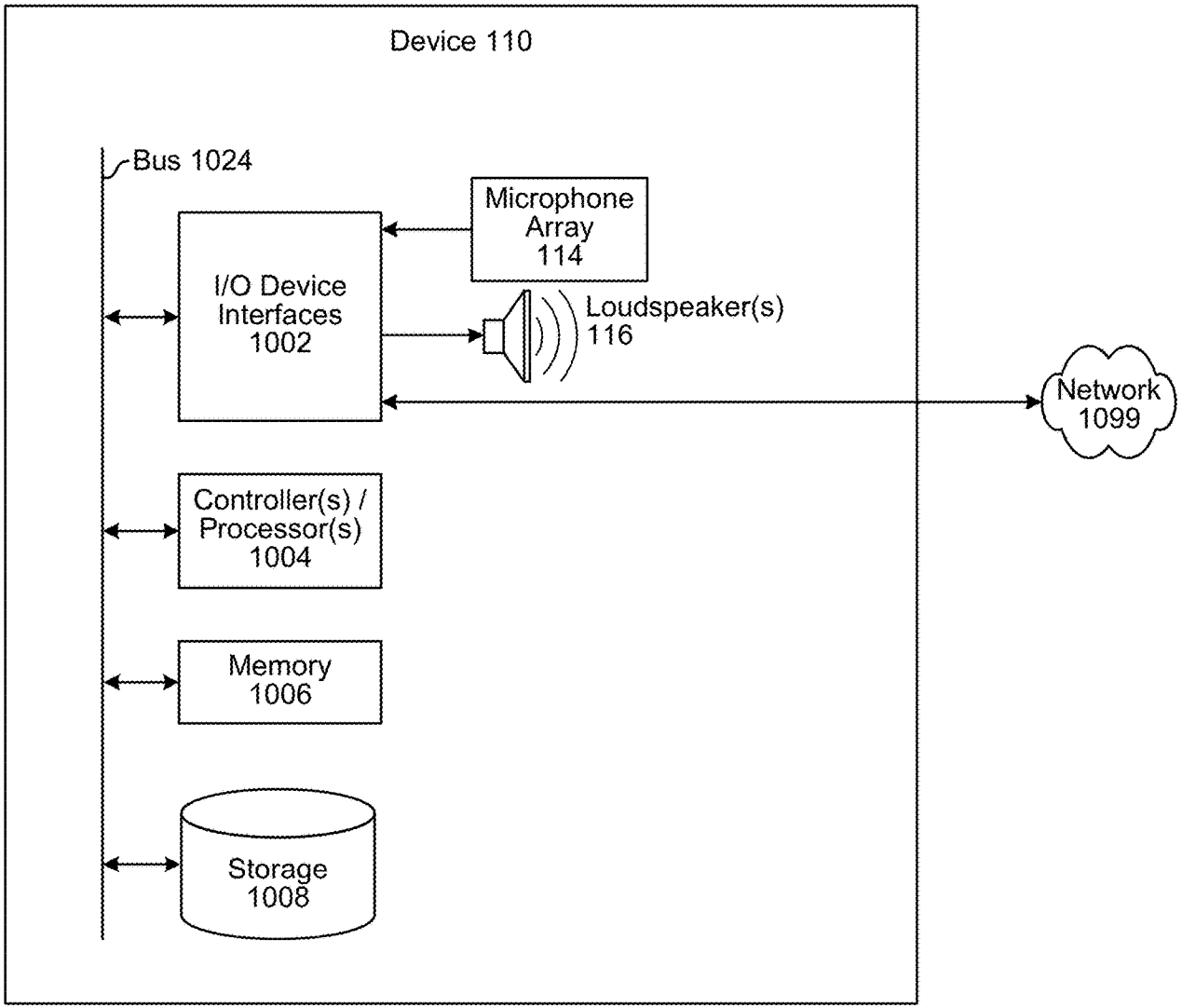
FIG. 10 is a block diagram conceptually illustrating example components of a device according to embodiments of the present disclosure.

FIG. 10 is a block diagram conceptually illustrating example components of the device 110. In operation, the device 110 may include computer-readable and computer-executable instructions that reside on the device, as will be discussed further below.

The device 110 may include one or more audio capture device(s), such as a microphone array 114 which may include a plurality of microphones 502. The audio capture device(s) may be integrated into a single device or may be separate.

The device 110 may also include an audio output device for producing sound, such as loudspeaker(s) 116. The audio output device may be integrated into a single device or may be separate.

The device 110 may include an address/data bus 1024 for conveying data among components of the device 110. Each component within the device may also be directly connected to other components in addition to (or instead of) being connected to other components across the bus 1024.

The device 110 may include one or more controllers/processors 1004, that may each include a central processing unit (CPU) for processing data and computer-readable instructions, and a memory 1006 for storing data and instructions. The memory 1006 may include volatile random access memory (RAM), non-volatile read only memory (ROM), non-volatile magnetoresistive (MRAM) and/or other types of memory. The device 110 may also include a data storage component 1008, for storing data and controller/processor-executable instructions (e.g., instructions to perform operations discussed herein). The data storage component 1008 may include one or more non-volatile storage types such as magnetic storage, optical storage, solid-state storage, etc. The device 110 may also be connected to removable or external non-volatile memory and/or storage (such as a removable memory card, memory key drive, networked storage, etc.) through the input/output device interfaces 1002.

Computer instructions for operating the device 110 and its various components may be executed by the controller(s)/processor(s) 1004, using the memory 1006 as temporary "working" storage at runtime. The computer instructions may be stored in a non-transitory manner in non-volatile memory 1006, storage 1008, or an external device. Alternatively, some or all of the executable instructions may be embedded in hardware or firmware in addition to or instead of software.

The device 110 may include input/output device interfaces 1002. A variety of components may be connected through the input/output device interfaces 1002, such as the microphone array 114, the loudspeaker(s) 116, and a media source such as a digital media player (not illustrated). The input/output interfaces 1002 may include A/D converters (not illustrated) and/or D/A converters (not illustrated).

The input/output device interfaces 1002 may also include an interface for an external peripheral device connection such as universal serial bus (USB), FireWire, Thunderbolt or other connection protocol. The input/output device interfaces 1002 may also include a connection to one or more networks 1099 via an Ethernet port, a wireless local area network (WLAN) (such as WiFi) radio, Bluetooth, and/or wireless network radio, such as a radio capable of communication with a wireless communication network such as a Long Term Evolution (LTE) network, WiMAX network, 3G network, etc. Through the network 1099, the device 110 may be distributed across a networked environment.

Multiple devices may be employed in a single device 110. In such a multi-device device, each of the devices may include different components for performing different aspects of the processes discussed above. The multiple devices may include overlapping components. The components listed in any of the figures herein are exemplary, and may be included a stand-alone device or may be included, in whole or in part, as a component of a larger device or system. For example, certain components such as an FBF unit 440 (including filter and sum component 430) and adaptive noise canceller (ANC) unit 460 may be arranged as illustrated or may be arranged in a different manner, or removed entirely and/or joined with other non-illustrated components.

The concepts disclosed herein may be applied within a number of different devices and computer systems, including, for example, general-purpose computing systems, multimedia set-top boxes, televisions, stereos, radios, server-client computing systems, telephone computing systems, laptop computers, cellular phones, personal digital assistants (PDAs), tablet computers, wearable computing devices (watches, glasses, etc.), other mobile devices, etc.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of digital signal processing and echo cancellation should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk and/or other media. Some or all of the adaptive noise canceller (ANC) unit 460, adaptive beamformer (ABF) unit 490, etc. may be implemented by a digital signal processor (DSP).

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method comprising:

receiving first audio data associated with a first microphone and second audio data associated with a second microphone, the first audio data and the second audio data associated with audio from a first time interval;

determining, using one or more beamformers and based at least in part on at least one of the first audio data or the second audio data, a first audio signal corresponding to a first direction and a second audio signal corresponding to a second direction;

determining that the first audio signal includes a first representation of first acoustic noise;

determining a first filter coefficient value using third audio data corresponding to a second time interval occurring prior to the first time interval;

processing the first audio signal using the first filter coefficient value to determine noise estimate data corresponding to a second representation of the first acoustic noise; and determining output audio data based on at least in part on the first audio data, the second audio data, and the noise estimate data.

2. The computer-implemented method of claim 1, further comprising:

determining a first time delay corresponding to an estimated length of time associated with utterance of a wakeword, wherein processing the first audio signal using the first filter coefficient value to determine the noise estimate data is based at least in part on the first time delay.

3. The computer-implemented method of claim 1, further comprising:

determining that the second audio signal includes a second representation of the first acoustic noise;

determining that a first portion of the first audio signal corresponds to a higher energy level than a second portion of the second audio signal; and determining an updated first filter coefficient value based on the first audio signal.

4. The computer-implemented method of claim 1, further comprising:

determining that the first representation of the first acoustic noise corresponds to a first energy level associated with the first time interval;

determining that the second audio signal includes a second representation of the first acoustic noise;

determining that the second representation of the first acoustic noise corresponds to a second energy level associated with first time interval;

determining that the second energy level is higher than the first energy level;

determining that a first beam corresponding to the first audio signal corresponds to a first direction adjacent to a second direction corresponding to a second beam corresponding to the second audio signal;

selecting the first audio signal, the first audio signal having been previously selected in association with the second time interval; and determining the first filter coefficient value based on the first audio signal.

5. The computer-implemented method of claim 1, wherein:

the noise estimate data comprises a first portion of noise estimate data corresponding to the first microphone and a second portion of noise estimate data corresponding to the second microphone; and determining the output audio data comprises:

subtracting the first portion of noise estimate data from the first audio data to determine a first portion of the output audio data; and subtracting the second portion of noise estimate data from the second audio data to determine a second portion of the output audio data.

6. The computer-implemented method of claim 1, further comprising:

determining an attenuation factor based at least in part on a signal quality associated with at least the first audio data, a diffuseness associated with at least the first audio signal, and a gain limit value;

determining attenuated noise estimate data based on the noise estimate data and the attenuation factor; and determining the output audio data further based at least in part on the attenuated noise estimate data.

7. The computer-implemented method of claim 1, further comprising:

determining a first time delay corresponding to an estimated length of time associated with utterance of a wakeword;

determining that first microphone audio data received prior to detection of the wakeword is representative of noise;

determining that second microphone audio data received during the first time delay is representative of the wakeword; and determining that third microphone audio data received after the first time delay is representative of noise.

8. The computer-implemented method of claim 1, further comprising:

determining an attenuation factor based at least in part on the first audio data, the second audio data, the first audio signal, and the second audio signal;

determining attenuated noise estimate data based on the noise estimate data and the attenuation factor; and determining the output audio data further based at least in part on the attenuated noise estimate data.

9. The computer-implemented method of claim 8, wherein:

the attenuated noise estimate data comprises first attenuated noise estimate data corresponding to the first microphone and second attenuated noise estimate data corresponding to the second microphone; and determining the output audio data comprises:

subtracting the first attenuated noise estimate data from the first audio data to determine a first portion of the output audio data; and subtracting the second attenuated noise estimate data from the second audio data to determine a second portion of the output audio data.

10. A system comprising:

at least one processor; and memory including instructions operable to be executed by the at least one processor to cause the system to:

receive first audio data associated with a first microphone and second audio data associated with a second microphone, the first audio data and the second audio data associated with audio from a first time interval;

determine, using one or more beamformers and based at least in part on at least one of the first audio data and the second audio data, a first audio signal corresponding to a first direction and a second audio signal corresponding to a second direction;

determine that the first audio signal includes a first representation of first acoustic noise;

determine a first filter coefficient value using third audio data corresponding to a second time interval occurring prior to the first time interval;

process the first audio signal using the first filter coefficient value to determine noise estimate data corresponding to a second representation of the first acoustic noise; and determine output audio data based at least in part on the first audio data, the second audio data, and the noise estimate data.

11. The system of claim 10, wherein the memory further comprises instructions that, when executed by the at least one processor, further cause the system to:

determine a first time delay corresponding to an estimated length of time associated with utterance of a wakeword, wherein processing the first audio signal using the first filter coefficient value to determine the noise estimate data is based at least in part on the first time delay.

12. The system of claim 10, wherein the memory further comprises instructions that, when executed by the at least one processor, further cause the system to:

determine that the second audio signal includes a second representation of the first acoustic noise;

determine that a first portion of the first audio signal corresponds to a higher energy level than a second portion of the second audio signal; and determine an updated first filter coefficient value based on the first audio signal.

13. The system of claim 10, wherein the memory further comprises instructions that, when executed by the at least one processor, further cause the system to:

determine that the first representation of the first acoustic noise corresponds to a first energy level associated with the first time interval;

determine that the second audio signal includes a second representation of the first acoustic noise;

determine that the second representation of the first acoustic noise corresponds to a second energy level associated with first time interval;

determine that the second energy level is higher than the first energy level;

determine that a first beam corresponding to the first audio signal corresponds to a first direction adjacent to a second direction corresponding to a second beam corresponding to the second audio signal;

select the first audio signal, the first audio signal having been previously selected in association with the second time interval; and determine the first filter coefficient value based on the first audio signal.

14. The system of claim 10, wherein:

the noise estimate data comprises a first portion of noise estimate data corresponding to the first microphone and a second portion of noise estimate data corresponding to the second microphone; and determining the output audio data comprises:

subtracting the first portion of noise estimate data from the first audio data to determine a first portion of the output audio data; and subtracting the second portion of noise estimate data from the second audio data to determine a second portion of the output audio data.

15. The system of claim 10, wherein the memory further comprises instructions that, when executed by the at least one processor, further cause the system to:

determine an attenuation factor based at least in part on a signal quality associated with at least the first audio data, a diffuseness associated with at least the first audio signal, and a gain limit value;

determine attenuated noise estimate data based on the noise estimate data and the attenuation factor; and determining the output audio data further based at least in part on the attenuated noise estimate data.

16. The system of claim 10, wherein the memory further comprises instructions that, when executed by the at least one processor, further cause the system to:

determine a first time delay corresponding to an estimated length of time associated with utterance of a wakeword;

determine that first microphone audio data received prior to detection of the wakeword is representative of noise;

determine that second microphone audio data received during the first time delay is representative of the wakeword; and determine that third microphone audio data received after the first time delay is representative of noise.

17. The system of claim 10, wherein the memory further comprises instructions that, when executed by the at least one processor, further cause the system to:

determine an attenuation factor based at least in part on the first audio data, the second audio data, the first audio signal, and the second audio signal; and determine attenuated noise estimate data based on the noise estimate data and the attenuation factor, wherein determining the output audio data uses the attenuated noise estimate data.

18. The system of claim 17, wherein:

the attenuated noise estimate data comprises first attenuated estimate data corresponding to the first microphone and second attenuated estimate data corresponding to the second microphone; and determining the output audio data comprises:

subtracting the first attenuated estimate data from the first audio data to determine a first portion of the output audio data; and subtracting the second attenuated estimate data from the second audio data to determine a second portion of the output audio data.

19. A computer-implemented method, the method comprising:

determining a first audio signal corresponding to a first direction and a second audio signal corresponding to a second direction;

determining that (i) the first audio signal includes a first representation of first acoustic noise, (ii) the second audio signal includes a second representation of the first acoustic noise, and (iii) a first portion of the first audio signal including the first representation of the first acoustic noise corresponds to a higher energy level than a second portion of the second audio signal including the second representation of the first acoustic noise;

determining a first filter coefficient value based on the first audio signal;

processing the first audio signal using the first filter coefficient value to determine noise estimate data;

determining attenuated noise estimate data based on the noise estimate data and an attenuation factor; and determining output audio data based at least in part on the attenuated noise estimate data.

20. The computer-implemented method of claim 19, further comprising:

determining the attenuation factor based at least in part on a signal quality associated with the first audio signal and the second audio signal, a, a diffuseness associated with the first audio signal and the second audio signal, and a gain limit.

* * * * *